US010902787B2

(12) United States Patent
Peng et al.

(10) Patent No.: US 10,902,787 B2
(45) Date of Patent: Jan. 26, 2021

(54) ASYNCHRONOUS CONTROL OF DISPLAY UPDATE AND LIGHT EMISSION

(71) Applicant: SHANGHAI YUNYINGGU TECHNOLOGY CO., LTD., Shanghai (CN)

(72) Inventors: Yu-Hsun Peng, Shanghai (CN); Shih-Wei Tseng, Shanghai (CN); Jing Gu, Shanghai (CN)

(73) Assignee: SHANGHAI YUNYINGGU TECHNOLOGY CO., LTD., Shanghai (CN)

( * ) Notice: Subject to any disclaimer, the term of this patent is extended or adjusted under 35 U.S.C. 154(b) by 0 days.

(21) Appl. No.: 16/222,756

(22) Filed: Dec. 17, 2018

(65) Prior Publication Data

US 2019/0139496 A1 May 9, 2019

Related U.S. Application Data

(63) Continuation of application No. PCT/CN2017/070572, filed on Jan. 8, 2017.

(51) Int. Cl.
*G09G 3/32* (2016.01)
*G09G 3/3266* (2016.01)
(Continued)

(52) U.S. Cl.
CPC ..... *G09G 3/3266* (2013.01); *G09G 3/32* (2013.01); *G09G 3/3233* (2013.01); *G09G 3/342* (2013.01);
(Continued)

(58) Field of Classification Search
CPC ..... G09G 2310/0237; G09G 2310/024; G09G 2310/08; G09G 2320/0257;
(Continued)

(56) References Cited

U.S. PATENT DOCUMENTS 5,929,832 A * 7/1999 Furukawa ..... G09G 3/3625 345/98
6,040,826 A * 3/2000 Furukawa ..... G09G 3/3625 345/534
(Continued)

FOREIGN PATENT DOCUMENTS

CN 101646097 A 2/2010
CN 104025183 A 9/2014
(Continued)

OTHER PUBLICATIONS

International Search Report issued in parallel PCT application No. PCT/CN2017/070572, dated Sep. 28, 2017, 4 pages.
(Continued)

*Primary Examiner* — Tony O Davis
(74) *Attorney, Agent, or Firm* — Bayes PLLC

(57) ABSTRACT

An apparatus for display includes an active region, a gate scanning driver, and light emitting driver. The active region includes a plurality of subpixels. The gate scanning driver is operatively coupled to the active region and configured to scan the plurality of subpixels in a first period of each frame at a first rate. The light emitting driver is operatively coupled to the active region and configured to cause the plurality of subpixels to start emitting light in a second period of each frame at a second rate. The second rate is higher than the first rate. The second period overlaps the first period.

18 Claims, 17 Drawing Sheets

(51) Int. Cl.
*G09G 3/3233* (2016.01)
*G09G 3/34* (2006.01)
*G09G 3/36* (2006.01)

(52) U.S. Cl.
CPC ..... *G09G 3/36* (2013.01); *G09G 2310/024* (2013.01); *G09G 2310/0237* (2013.01); *G09G 2310/08* (2013.01); *G09G 2320/0257* (2013.01); *G09G 2320/064* (2013.01)

(58) Field of Classification Search
CPC .. G09G 2320/064; G09G 3/32; G09G 3/3233; G09G 3/3266; G09G 3/342; G09G 3/36
USPC ..... 345/76, 98, 103, 596, 204–213
See application file for complete search history.

(56) References Cited

U.S. PATENT DOCUMENTS 8,487,864 B2 * 7/2013 Itoh ..... G09G 3/3677 345/103
2002/0093468 A1 7/2002 Ouchi et al.
2004/0100429 A1 5/2004 Kuriki
2006/0007075 A1 * 1/2006 Adachi ..... G09G 3/3216 345/76
2006/0145964 A1 * 7/2006 Park ..... G09G 3/3233 345/76
2012/0105390 A1 * 5/2012 Kim ..... G09G 3/003 345/204
2016/0063961 A1 * 3/2016 Pyo ..... G09G 3/2022 345/213
2016/0267877 A1 * 9/2016 Patel ..... G09G 3/2014
2017/0068312 A1 * 3/2017 Mallinson ..... G06F 3/011
2017/0192235 A1 * 7/2017 Petrov ..... G02B 27/0172
2018/0286315 A1 * 10/2018 Zhang ..... G09G 3/3685
2018/0293939 A1 * 10/2018 Kim ..... H01L 51/5203
2019/0139496 A1 * 5/2019 Peng ..... G09G 3/342
2020/0020280 A1 * 1/2020 Han ..... G09G 3/3291

FOREIGN PATENT DOCUMENTS

CN 104471634 A 3/2015
CN 104885141 A 9/2015

OTHER PUBLICATIONS

Written Opinion of the International Searching Authority issued in parallel PCT application No. PCT/2017/070572, dated Sep. 28, 2017, 3 pages.

* cited by examiner

ASYNCHRONOUS CONTROL OF DISPLAY UPDATE AND LIGHT EMISSION

CROSS REFERENCE TO RELATED APPLICATION

This application is continuation of International Application No. PCT/CN2017/070572, filed on Jan. 8, 2017, entitled "ASYNCHRONOUS CONTROL OF DISPLAY UPDATE AND LIGHT EMISSION," which is hereby incorporated by reference in its entirety.

BACKGROUND

The disclosure relates generally to display technologies, and more particularly, to display panel driving.

Emerging applications of display technologies, such as virtual reality (VR) and augmented reality (AR), oftentimes require high frame rate and low latency in order to respond immediately to users' movement with updated display images, thereby providing immersion and preventing cybersickness and motion blur. For example, because users may quickly or drastically move their heads when wearing a VR headset, two consecutive display images can be substantially different. Display systems using traditional driving schemes, such as the line-scanning driving, may cause the upper and lower portions of the display screen present content from different display images (a.k.a. "image broken"), which would cause cybersickness. Other display systems using low-persistence driving tried to overcome this problem by presenting each display image only after the entire image has been updated on the display panel. However, as display data update (and gate scan) and light emission in these display systems have to occur in two subsequent periods in each frame, display data interface bandwidth and gate scan frequency are increased, and the average brightness of each frame is reduced by low-persistence driving.

SUMMARY

In one example, an apparatus for display includes an active region, a gate scanning driver, and light emitting driver. The active region includes a plurality of subpixels. The gate scanning driver is operatively coupled to the active region and configured to scan the plurality of subpixels in a first period of each frame at a first rate. The light emitting driver is operatively coupled to the active region and configured to cause the plurality of subpixels to start emitting light in a second period of each frame at a second rate. The second rate is higher than the first rate. The second period overlaps the first period.

In another example, a system for display includes an active region, control logic, a gate scanning driver, and light emitting driver. The active region includes a plurality of subpixels. The control logic is configured to provide a plurality of control signals comprising a first set of enable signals, a first set of clock signals, a second set of enable signals, and a second set of clock signals. The gate scanning driver is operatively coupled to the active region and the control logic and configured to scan the plurality of subpixels in a first period of each frame at a first rate based at least in part on the first set of enable signals and the first set of clock signals. The light emitting driver is operatively coupled to the active region and the control logic and configured to cause the plurality of subpixels to start emitting light in a second period of each frame at a second rate based at least in part on the second set of enable signals and the second set of clock signals. The second rate is higher than the first rate. The second period overlaps the first period.

In still another example, an apparatus includes a timing controller and a clock generator. The timing controller is configured to provide a first set of enable signals and a second set of enable signals. The clock generator is configured to provide a first set of clock signals associated with a first clock frequency and a second set of clock signals associated with a second clock frequency that is higher than the first clock frequency. The first set of enable signals and the first set of clock signals control a gate scanning driver to sequentially scan a plurality of rows of subpixels on a display panel in accordance with the first clock frequency. The second set of enable signals and the second set of clock signals control light emitting driver to sequentially cause the plurality of rows of subpixels to start emitting light in accordance with the second clock frequency.

In a different example, a method of driving a plurality of subpixels on a display panel is provided. The plurality of subpixels are scanned in a first period of each frame at a first rate. The plurality of subpixels are caused to start emitting light in a second period of each frame at a second rate. The second rate is higher than the first rate. The second period overlaps the first period.

BRIEF DESCRIPTION OF THE DRAWINGS

The accompanying drawings, which are incorporated herein and form part of the specification, illustrate the presented disclosure and, together with the description, further serve to explain the principles of the disclosure and enable a person of skill in the relevant art(s) to make and use the disclosure.

Figure 1:
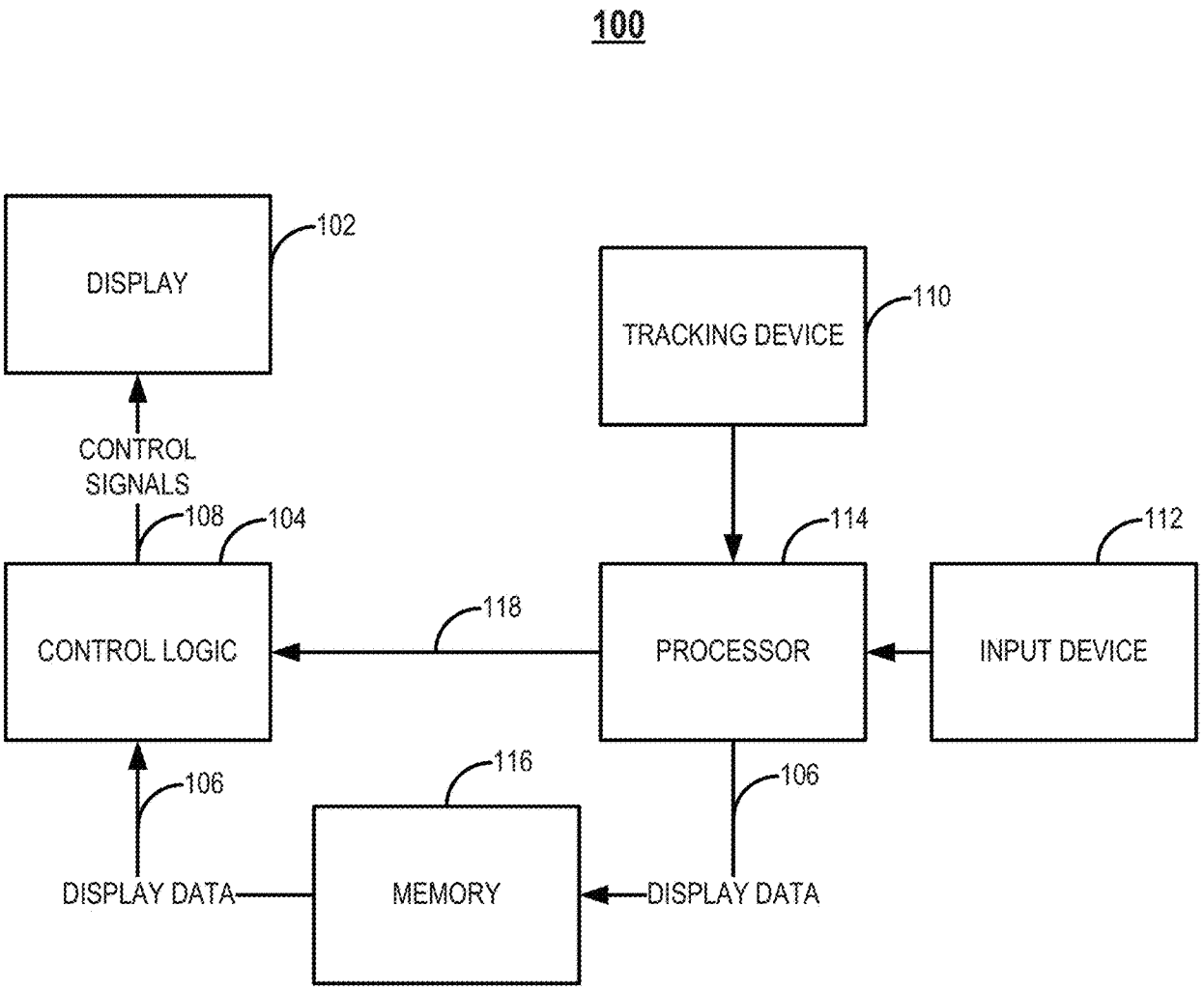
FIG. 1 is a block diagram illustrating an apparatus including a display and control logic in accordance with an embodiment.

The presented disclosure is described with reference to the accompanying drawings. In the drawings, generally, like reference numbers indicate identical or functionally similar elements. Additionally, generally, the left-most digit(s) of a reference number identifies the drawing in which the reference number first appears.

DETAILED DESCRIPTION

In the following detailed description, numerous specific details are set forth by way of examples in order to provide a thorough understanding of the relevant disclosures. However, it should be apparent to those skilled in the art that the present disclosure may be practiced without such details. In other instances, well known methods, procedures, systems, components, and/or circuitry have been described at a relatively high-level, without detail, in order to avoid unnecessarily obscuring aspects of the present disclosure.

Throughout the specification and claims, terms may have nuanced meanings suggested or implied in context beyond an explicitly stated meaning. Likewise, the phrase "in one embodiment/example" as used herein does not necessarily refer to the same embodiment and the phrase "in another embodiment/example" as used herein does not necessarily refer to a different embodiment. It is intended, for example, that claimed subject matter include combinations of example embodiments in whole or in part.

In general, terminology may be understood at least in part from usage in context. For example, terms, such as "and," "or," or "and/or," as used herein may include a variety of meanings that may depend at least in part upon the context in which such terms are used. Typically, "or" if used to associate a list, such as A, B or C, is intended to mean A, B, and C, here used in the inclusive sense, as well as A, B or C, here used in the exclusive sense. In addition, the term "one or more" as used herein, depending at least in part upon context, may be used to describe any feature, structure, or characteristic in a singular sense or may be used to describe combinations of features, structures or characteristics in a plural sense. Similarly, terms, such as "a," "an," or "the," again, may be understood to convey a singular usage or to convey a plural usage, depending at least in part upon context. In addition, the term "based on" may be understood as not necessarily intended to convey an exclusive set of factors and may, instead, allow for existence of additional factors not necessarily expressly described, again, depending at least in part on context.

As will be disclosed in detail below, among other novel features, the display system, apparatus, and method in the present disclosure can reduce cybersickness and motion blur effect by avoiding "image broken." For example, by controlling display update and light emission on the display panel at different rates, the display panel driving scheme disclosed herein can ensure the integrity and continuity of consecutive images, i.e., only display data of the same frame can be rendered on the display panel at the same time. Different from low-persistence driving, the display panel driving scheme disclosed herein does not require display update and light emission to occur in subsequent periods, thereby avoiding the increase of display data interface bandwidth and panel scan frequency, which can significantly overload the display system and increase manufacturing cost. The average brightness of each frame can also be flexibly adjusted as desired by the display panel driving scheme disclosed herein. Accordingly, the display system, apparatus, and method in the present disclosure can be suitable for display applications that require an immediate response to users' movement with updated display images, such as VR/AR displays.

Additional novel features will be set forth in part in the description which follows, and in part will become apparent to those skilled in the art upon examination of the following and the accompanying drawings or may be learned by production or operation of the examples. The novel features of the present disclosure may be realized and attained by practice or use of various aspects of the methodologies, instrumentalities, and combinations set forth in the detailed examples discussed below.

FIG. 1 illustrates an apparatus 100 including a display 102 and control logic 104. Apparatus 100 may be any suitable device, for example, a VR/AR device (e.g., VR headset, etc.), handheld device (e.g., dumb or smart phone, tablet, etc.), wearable device (e.g., eyeglasses, wrist watch, etc.), automobile control station, gaming console, television set, laptop computer, desktop computer, netbook computer, media center, set-top box, global positioning system (GPS), electronic billboard, electronic sign, printer, or any other suitable device. In this embodiment, display 102 is operatively coupled to control logic 104 and is part of apparatus 100, such as but not limited to, a head-mounted display, computer monitor, television screen, head-up display (HUD), dashboard, electronic billboard, or electronic sign. Display 102 may be an OLED display, microLED display, liquid crystal display (LCD), E-ink display, electroluminescent display (ELD), billboard display with LED or incandescent lamps, or any other suitable type of display.

Control logic 104 may be any suitable hardware, software, firmware, or combination thereof, configured to receive display data 106 (e.g., pixel data) and generate control signals 108 for driving the subpixels on display 102. Control signals 108 are used for controlling writing of display data to the subpixels and directing operations of display 102. For example, subpixel rendering (SPR) algorithms for various subpixel arrangements may be part of control logic 104 or implemented by control logic 104. As described below in detail with respect to FIG. 5, control logic 104 in one embodiment may include a data interface 502 and a control signal generating module 504 having a timing controller (TCON) 506 and a clock generator 508. Control logic 104 may include any other suitable components, such as an encoder, a decoder, one or more processors, controllers, and storage devices. Control logic 104 may be implemented as a standalone integrated circuit (IC) chip, such as an application-specific integrated circuit (ASIC) or a field-programmable gate array (FPGA). In some embodiments, control logic 104 may be manufactured in a chip-on-glass (COG) package, for example, when display 102 is a rigid display. In some embodiments, control logic 104 may be manufactured in a chip-on-film (COF) package, for example, when display 102 is a flexible display, e.g., a flexible OLED display.

Apparatus 100 may also include any other suitable component such as, but not limited to tracking devices 110 (e.g., inertial sensors, camera, eye tracker, GPS, or any other suitable devices for tracking motion of eyeballs, facial expression, head movement, body movement, and hand gesture) and input devices 112 (e.g., a mouse, keyboard, remote controller, handwriting device, microphone, scanner, etc.).

In this embodiment, apparatus 100 may be a handheld or a VR/AR device, such as a smart phone, a tablet, or a VR headset. Apparatus 100 may also include a processor 114 and memory 116. Processor 114 may be, for example, a graphics processor (e.g., graphics processing unit (GPU)), an application processor (AP), a general processor (e.g., APU, accelerated processing unit; GPGPU, general-purpose computing on GPU), or any other suitable processor. Memory 116 may be, for example, a discrete frame buffer or a unified memory. Processor 114 is configured to generate display data 106 in consecutive display frames and may temporally store display data 106 in memory 116 before sending it to control logic 104. Processor 114 may also generate other data, such as but not limited to, control instructions 118 or test signals, and provide them to control logic 104 directly or through memory 116. Control logic 104 then receives display data 106 from memory 116 or directly from processor 114.

Figure 2A:
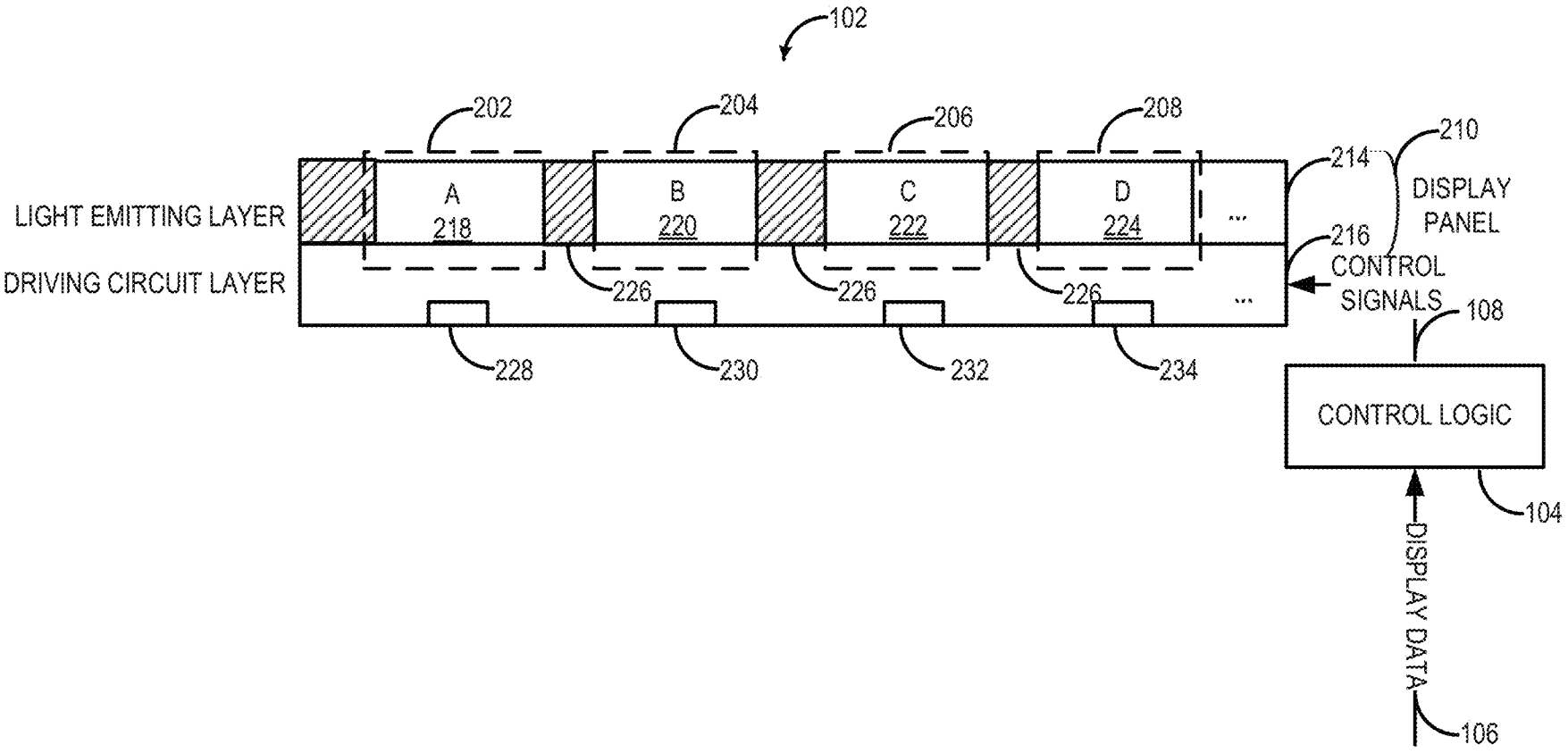
FIGS. 2A-2C are side-view diagrams illustrating various examples of the display shown in FIG. 1 in accordance with various embodiments.

FIG. 2A is a side-view diagram illustrating one example of display 102 including subpixels 202, 204, 206, and 208. Display 102 may be any suitable type of display, for example, OLED displays, such as an active-matrix OLED (AMOLED) display, or any other suitable display. Display 102 may include a display panel 210 operatively coupled to control logic 104. The example shown in FIG. 2A illustrates a side-by-side (a.k.a. lateral emitter) OLED color patterning architecture in which one color of light-emitting material is deposited through a metal shadow mask while the other color areas are blocked by the mask.

In this embodiment, display panel 210 includes light emitting layer 214 and a driving circuit layer 216. As shown in FIG. 2A, light emitting layer 214 includes a plurality of light emitting elements (e.g., OLEDs) 218, 220, 222, and 224, corresponding to a plurality of subpixels 202, 204, 206, and 208, respectively. A, B, C, and D in FIG. 2A denote OLEDs in different colors, such as but not limited to, red, green, blue, yellow, cyan, magenta, or white. Light emitting layer 214 also includes a black array 226 disposed between OLEDs 218, 220, 222, and 224, as shown in FIG. 2A. Black array 226, as the borders of subpixels 202, 204, 206, and 208, is used for blocking light coming out from the parts outside OLEDs 218, 220, 222, and 224. Each OLED 218, 220, 222, and 224 in light emitting layer 214 can emit light in a predetermined color and brightness.

In this embodiment, driving circuit layer 216 includes a plurality of pixel circuits 228, 230, 232, and 234, each of which includes one or more thin film transistors (TFTs), corresponding to OLEDs 218, 220, 222, and 224 of subpixels 202, 204, 206, and 208, respectively. Pixel circuits 228, 230, 232, and 234 may be individually addressed by control signals 108 from control logic 104 and configured to drive corresponding subpixels 202, 204, 206, and 208, by controlling the light emitting from respective OLEDs 218, 220, 222, and 224, according to control signals 108. Driving circuit layer 216 may further include one or more drivers (not shown) formed on the same substrate as pixel circuits 228, 230, 232, and 234. The on-panel drivers may include circuits for controlling light emitting, gate scanning, and data writing as described below in detail. Scan lines and data lines are also formed in driving circuit layer 216 for transmitting scan signals and data signals, respectively, from the drivers to each pixel circuit 228, 230, 232, and 234. Display panel 210 may include any other suitable component, such as one or more glass substrates, polarization layers, or a touch panel (not shown). Pixel circuits 228, 230, 232, and 234 and other components in driving circuit layer 216 in this embodiment are formed on a low temperature polycrystalline silicon (LTPS) layer deposited on a glass substrate, and the TFTs in each pixel circuit 228, 230, 232, and 234 are p-type transistors (e.g., PMOS LTPS-TFTs). In some embodiments, the components in driving circuit layer 216 may be formed on an amorphous silicon (a-Si) layer, and the TFTs in each pixel circuit may be n-type transistors (e.g., NMOS TFTs). In some embodiments, the TFTs in each pixel circuit may be organic TFTs (OTFT) or indium gallium zinc oxide (IGZO) TFTs.

As shown in FIG. 2A, each subpixel 202, 204, 206, and 208 is formed by at least an OLED 218, 220, 222, and 224 driven by a corresponding pixel circuit 228, 230, 232, and 234. Each OLED may be formed by a sandwich structure of an anode, an organic light-emitting layer, and a cathode. Depending on the characteristics (e.g., material, structure, etc.) of the organic light-emitting layer of the respective OLED, a subpixel may present a distinct color and brightness. Each OLED 218, 220, 222, and 224 in this embodiment is a top-emitting OLED. In some embodiments, the OLED may be in a different configuration, such as a bottom-emitting OLED. In one example, one pixel may consist of three subpixels, such as subpixels in the three primary colors (red, green, and blue) to present a full color. In another example, one pixel may consist of four subpixels, such as subpixels in the three primary colors (red, green, and blue) and the white color. In still another example, one pixel may consist of two subpixels. For example, subpixels A 202 and B 204 may constitute one pixel, and subpixels C 206 and D 208 may constitute another pixel. Here, since display data 106 is usually programmed at the pixel level, the two subpixels of each pixel or the multiple subpixels of several adjacent pixels may be addressed collectively by SPRs to present the appropriate brightness and color of each pixel, as designated in display data 106 (e.g., pixel data). However, it is to be appreciated that, in some embodiments, display data 106 may be programmed at the subpixel level such that display data 106 can directly address individual subpixel without SPRs. Because it usually requires three primary colors to present a full color, specifically designed subpixel arrangements may be provided for display 102 in conjunction with SPR algorithms to achieve an appropriate apparent color resolution.

Figure 2B:
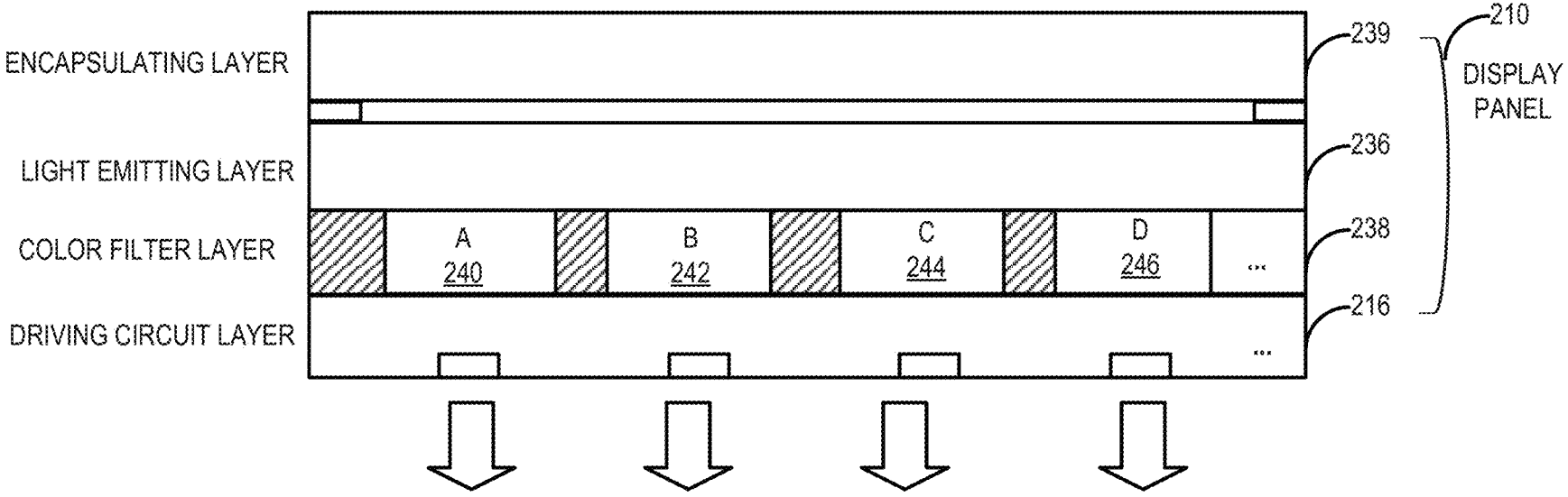

The example shown in FIG. 2A illustrates a side-by-side patterning architecture in which one color of light-emitting material is deposited through the metal shadow mask while the other color areas are blocked by the mask. In another example, a white OLEDs with color filters (WOLED+CF) patterning architecture can be applied to display panel 210. In the WOLED+CF architecture, a stack of light-emitting materials form light emitting layer of the white light. The color of each individual subpixel is defined by another layer of color filters in different colors. As the organic light-emitting materials do not need to be patterned through the metal shadow mask, the resolution and display size can be increased by the WOLED+CF patterning architecture. FIG. 2B illustrates an example of a WOLED+CF patterning architecture applied to display panel 210. Display panel 210 in this embodiment includes driving circuit layer 216, light emitting layer 236, a color filter layer 238, and an encapsulating layer 239. In this example, light emitting layer 236 includes a stack of light emitting sub-layers and emits the white light. Color filter layer 238 may be comprised of a color filter array having a plurality of color filters 240, 242, 244, and 246 corresponding to subpixels 202, 204, 206, and 208, respectively. A, B, C, and D in FIG. 2B denote four different colors of filters, such as but not limited to, red, green, blue, yellow, cyan, magenta, or white. Color filters 240, 242, 244, and 246 may be formed of a resin film in which dyes or pigments having the desired color are contained. Depending on the characteristics (e.g., color, thickness, etc.) of the respective color filter, a subpixel may present a distinct color and brightness. Encapsulating layer 239 may include an encapsulating glass substrate or a substrate fabricated by the thin film encapsulation (TFE) technology. Driving circuit layer 216 may be comprised of an array of pixel circuits including LTPS, IGZO, or OTFT transistors. Display panel 210 may include any other suitable components, such as polarization layers, or a touch panel (not shown).

Figure 2C:
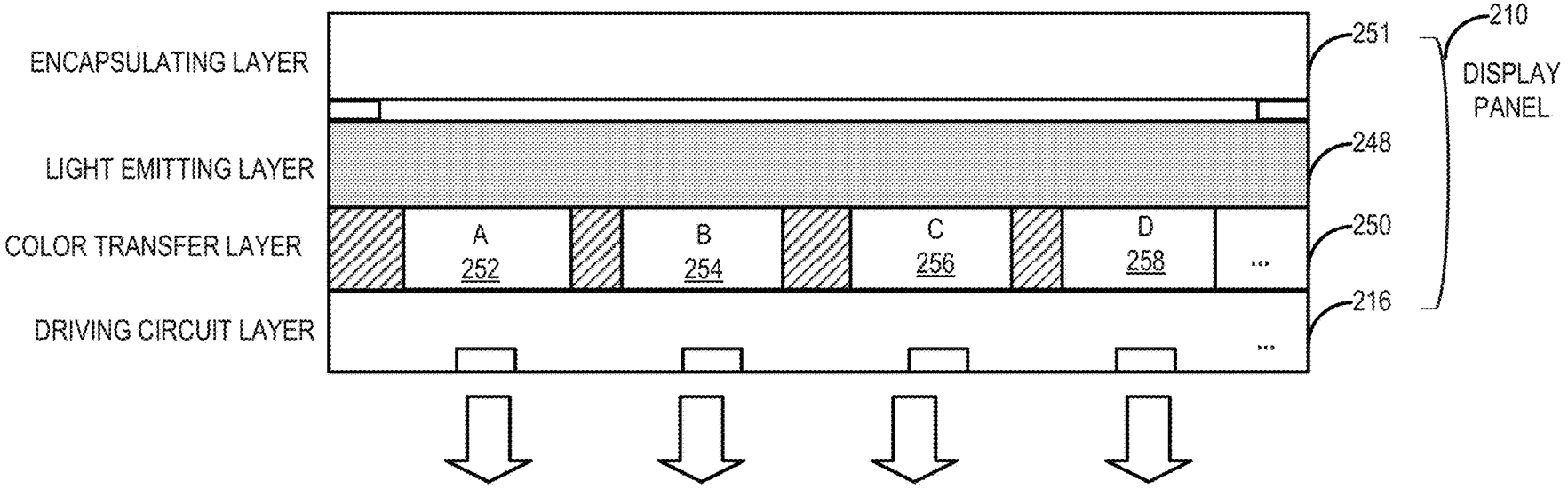

In still another example, a blue OLEDs with transfer color filters (BOLED+transfer CF) patterning architecture can be applied to display panel 210 as well. In the BOLED+transfer CF architecture, light-emitting material of blue light is deposited without a metal shadow mask, and the color of each individual subpixel is defined by another layer of transfer color filters for different colors. FIG. 2C illustrates an example of a BOLED+transfer CF patterning architecture applied to display panel 210. Display panel 210 in this embodiment includes driving circuit layer 216, light emitting layer 248, a color transfer layer 250, and an encapsulating layer 251. Light emitting layer 248 in this embodiment emits the blue light and can be deposited without a metal shadow mask. It is to be appreciated that in some embodiments, light emitting layer 248 may emit other colors of light. Color transfer layer 250 may be comprised of a transfer color filters array having a plurality of transfer color filters 252, 254, 256, and 258 corresponding to subpixels 202, 204, 206, and 208, respectively. A, B, C, and D in FIG. 2C denote four different colors of transfer color filters, such as but not limited to, red, green, blue, yellow, cyan, magenta, or white. Each type of transfer color filter may be formed of a color changing material. Depending on the characteristics (e.g., color, thickness, etc.) of the respective transfer color filter, a subpixel may present a distinct color and brightness. Encapsulating layer 251 may include an encapsulating glass substrate or a substrate fabricated by the TFE technology. Driving circuit layer 216 may be comprised of an array of pixel circuits including LTPS, IGZO, or OTFT transistors. Display panel 210 may include any other suitable component, such as polarization layers, or a touch panel (not shown).

The display panel driving scheme disclosed herein is suitable for any known OLED patterning architectures, including but not limited to, the side-by-side, WOLED+CF, and BOLED+CCM patterning architectures as described above. Although FIGS. 2A-2C are illustrated as an OLED display, it is to be appreciated that they are provided for an exemplary purpose only and without limitations. In some embodiments, the display panel driving scheme disclosed herein may be applied to microLED displays in which each subpixel includes a microLED. The display panel driving scheme disclosed herein may be applied to any other suitable displays in which each subpixel includes light emitting element.

Figure 3:
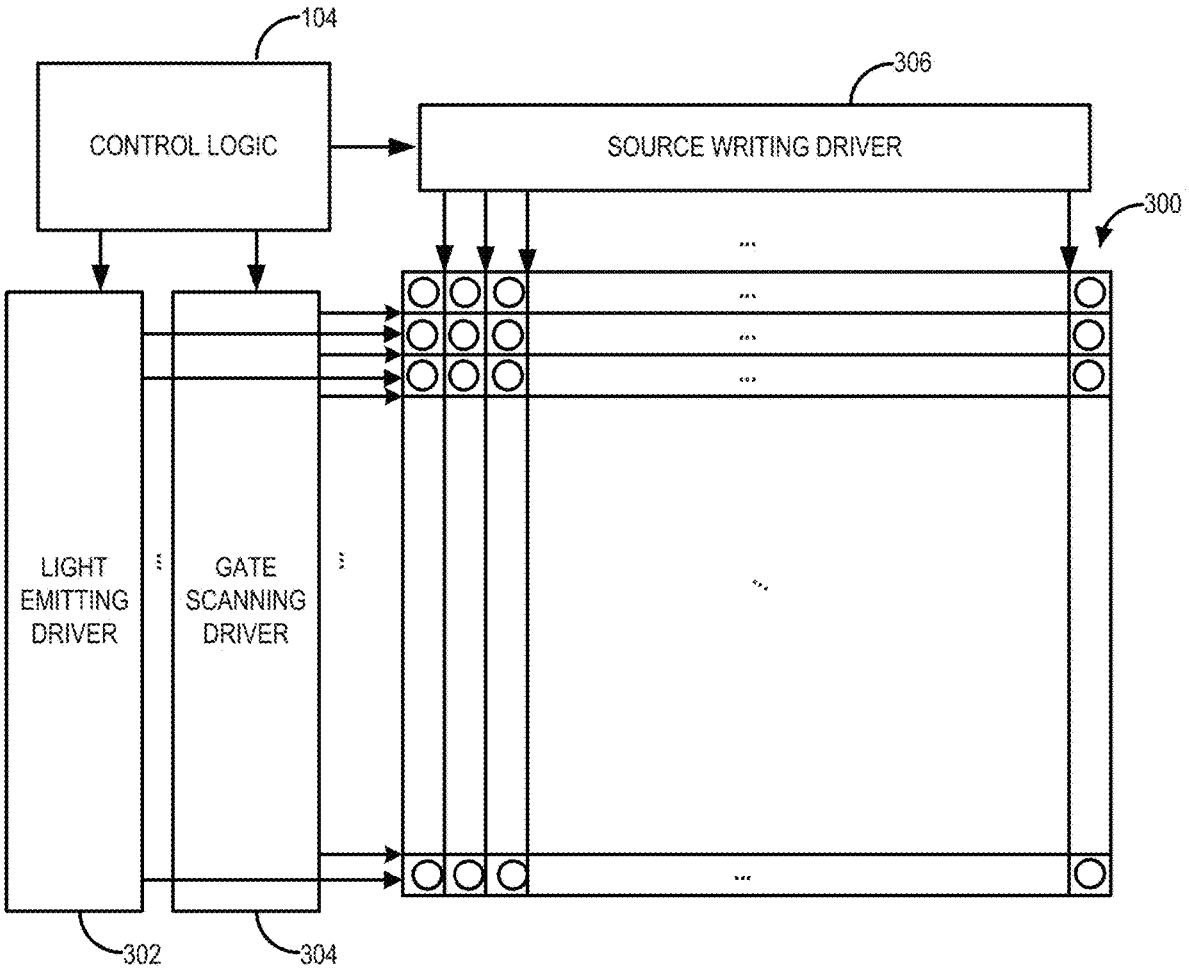
FIG. 3 is a block diagram illustrating the display shown in FIG. 1 including multiple drivers in accordance with an embodiment.

FIG. 3 is a block diagram illustrating display 102 shown in FIG. 1 including multiple drivers in accordance with an embodiment. Display 102 in this embodiment includes an active region 300 having a plurality of subpixels (e.g., each including an OLED or microLED), a plurality of pixel circuits (not shown), and multiple on-panel drivers including light emitting driver 302, a gate scanning driver 304, and a source writing driver 306. Light emitting driver 302, gate scanning driver 304, and source writing driver 306 are operatively coupled to control logic 104 and configured to drive the subpixels in active region 300 based on control signals 108 provided by control logic 104.

Figure 5:
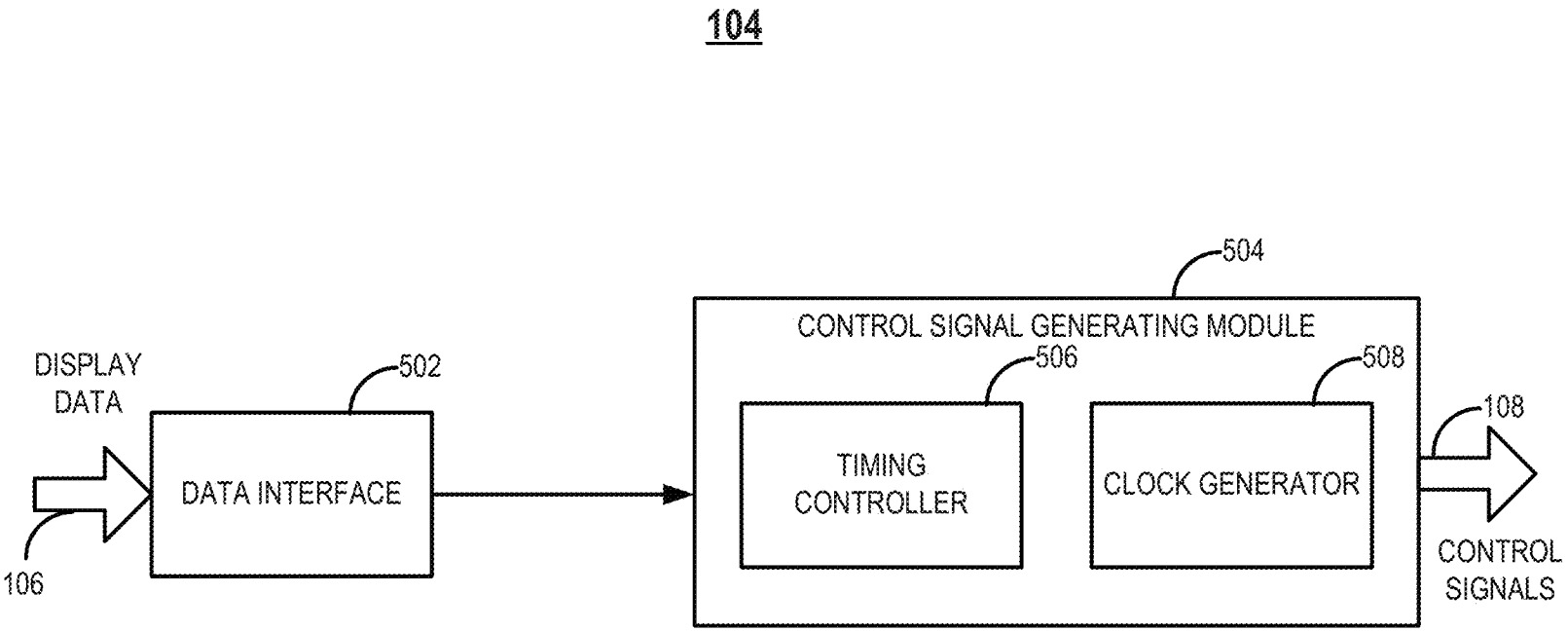
FIG. 5 is a block diagram illustrating an example of the control logic shown in FIGS. 1 and 3 in accordance with an embodiment.

Referring to FIG. 5 in which a block diagram of one example of control logic 104 is illustrated. In this embodiment, control logic 104 is an integrated circuit (but may alternatively include a state machine made of discrete logic and other components), which provides an interface function between processor 114/memory 116 and display 102. Control logic 104 may provide various control signals 108 with suitable voltage, current, timing, and de-multiplexing, to control display 102 to show the desired text or image. Control logic 104 may be an application-specific microcontroller and may include storage units such as RAM, flash memory, EEPROM, and/or ROM, which may store, for example, firmware and display fonts. In this embodiment, control logic 104 includes data interface 502 and control signal generating module 504. Data interface 502 may be any serial or parallel interface, such as but not limited to, display serial interface (DSI), display pixel interface (DPI), and display bus interface (DBI) by the Mobile Industry Processor Interface (MIPI) Alliance, unified display interface (UDI), digital visual interface (DVI), high-definition multimedia interface (HDMI), and DisplayPort (DP). Data interface 502 in this embodiment is configured to receive display data 106 and any other control instructions 118 or test signals from processor 114/memory 116. Display data 106 may be received in consecutive frames at any frame rate, such as 30, 60, 72, 90, 120, or 180 frames per second (fps). The received display data 106 is forwarded by data interface 502 to control signal generating module 504.

In this embodiment, control signal generating module 504 provides control signals 108 to on-panel drivers 302, 304, and 306. Control signals 108 control on-panel drivers 302, 304, and 306 to drive the subpixels in active region 300 by, in each frame, scanning the subpixels to update display data and causing the subpixels to emit light to present the updated display image. Control signal generating module 504 may include TCON 506 and clock generator 508. TCON 506 may provide a variety of enable signals (STV), including but not limited to, a first set of enable signals to gate scanning driver 304 and a second set of enable signals to light emitting driver 302. Clock generator 508 may provide a variety of clock signals (CLK), including but not limited to, a first set of clock signals to gate scanning driver 304 and a second set of clock signals to light emitting driver 302.

Figure 6:
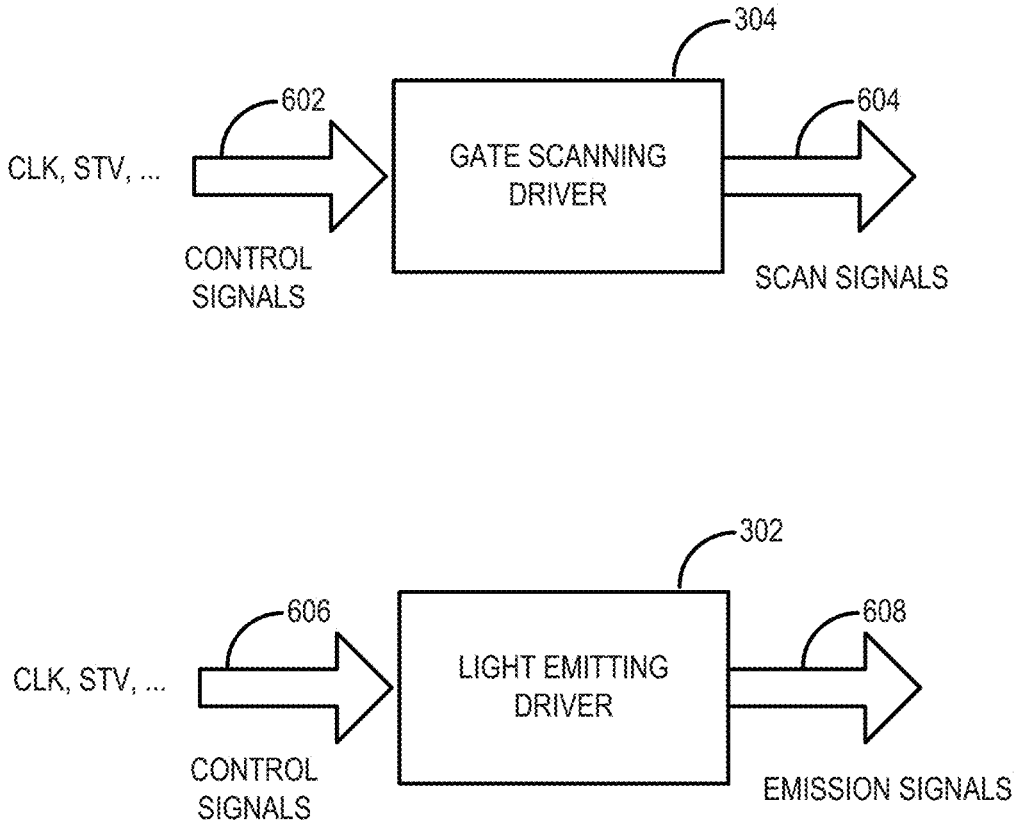
FIG. 6 is a depiction of an example of input and output signals of the light emitting driver and gate scanning driver shown in FIG. 3 in accordance with an embodiment.

For example, as shown in FIG. 6, control signal generating module 504 may provide a first set of control signals 602, including but not limited to, the first set of enable signals and the first set of clock signals, to gate scanning driver 304 to control gate scanning driver 304 to generate scan signals 604 for scanning the subpixels in active region 300 at a gate scanning rate in each frame. Control signal generating module 504 may also provide a second set of control signals 606, including but not limited to, the second set of enable signals and the second set of clock signals, to light emitting driver 302 to control light emitting driver 302 to generate emission signals 608 for causing the subpixels in active region 300 to emit light at light emitting rate in each frame. The details of the timing of each control signal 108 provided by control signal generating module 504 are described below in accordance with various embodiments of the present disclosure.

Referring back to FIG. 3, active region 300 may be the entire region of the display panel including all the subpixels arranged thereon. In some embodiments, active region 300 may be any portion of the entire display panel region and include subpixels in the corresponding region. In some embodiments, the display panel may be divided into multiple zones, and active region 300 may be one or more of the zones and include the corresponding subpixels in the zone(s). It is to be appreciated that a display panel may include a display region and a porch region. Light emitting elements in the display region can present content of display images based on display data 106, while light emitting elements in the porch region may emit light but not present any content of display images (not involved in display update). For ease of description, active region 300 refers thereafter to the entire display region with all the subpixels in the display region arranged in rows and columns. That is, the subpixels in active region 300 may include a plurality of rows of subpixels (lines).

Figure 4A:
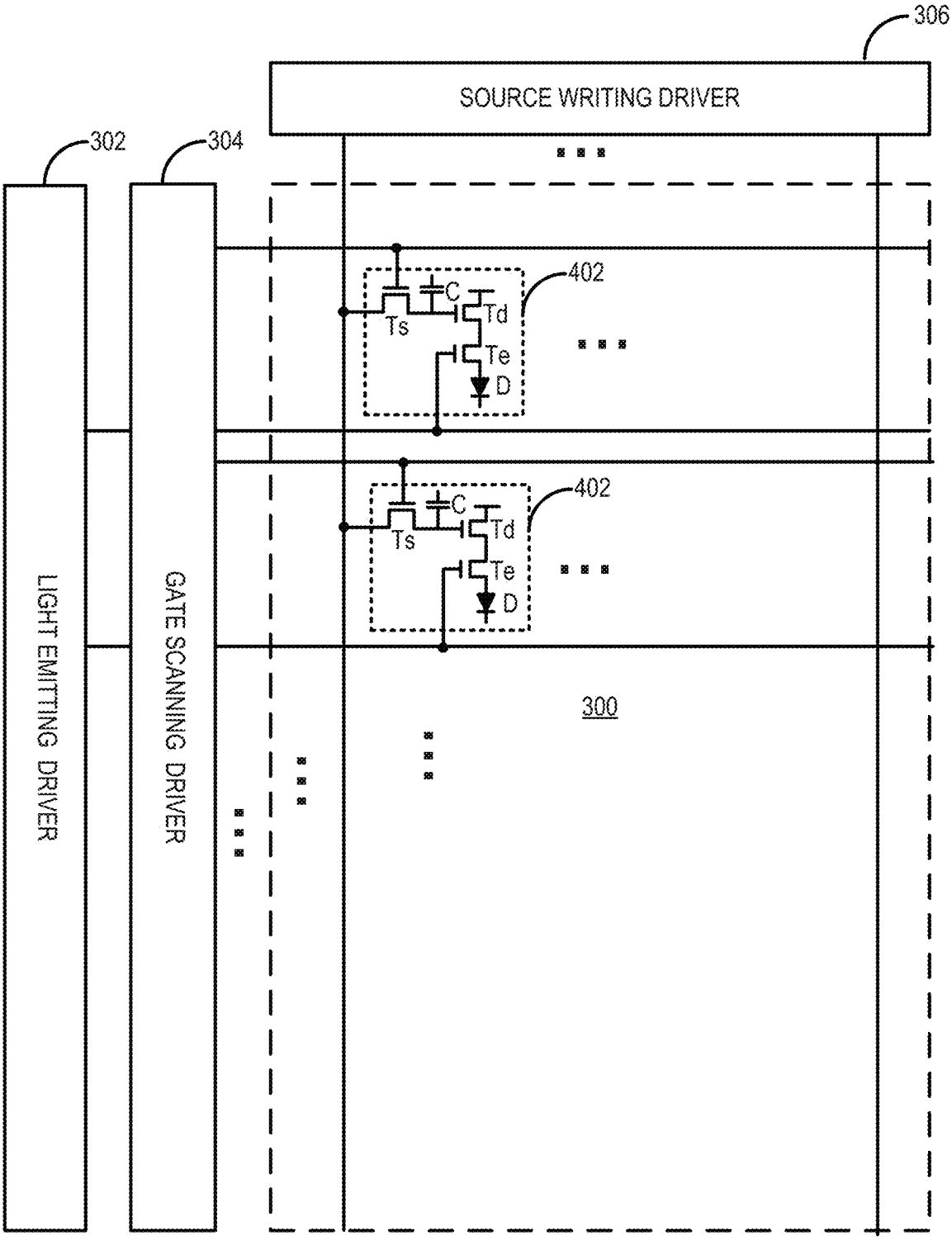
FIG. 4A is circuit diagram illustrating an example of a subpixel including light emitting element in an active region shown in FIG. 3 in accordance with an embodiment.
Figure 4B:
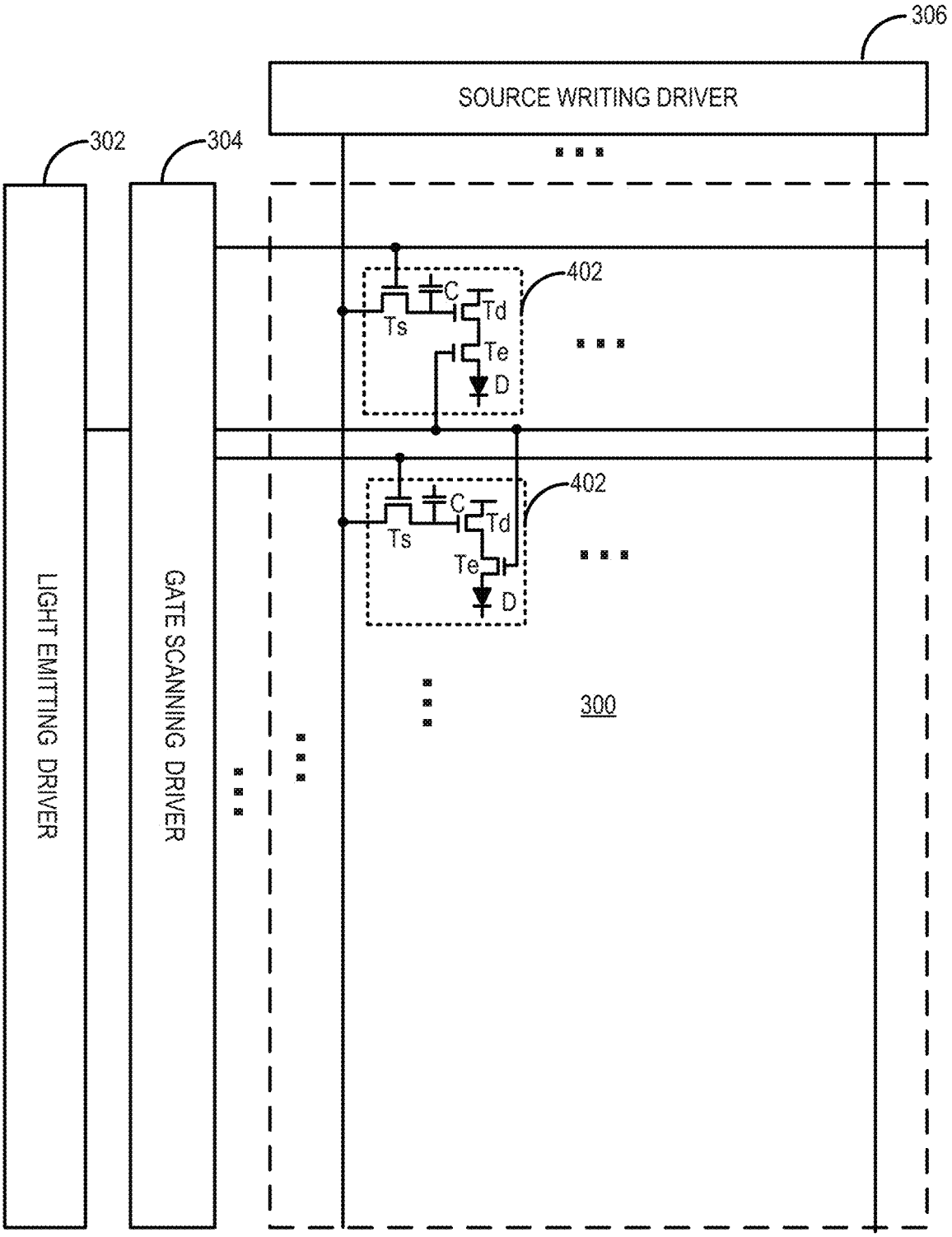
FIG. 4B is circuit diagram illustrating another example of a subpixel including light emitting element in an active region shown in FIG. 3 in accordance with an embodiment.

Referring to FIGS. 4A and 4B, each subpixel 402 may be light emitting element that can be individually addressed, such as an OLED or a microLED. In some embodiments in which display 102 is an OLED display, each subpixel 402 may include an OLED D, such as a top emitting OLED, and a pixel circuit for driving the OLED D. Each OLED D can emit light in a predetermined brightness and color, such as but not limited to, red, green, blue, yellow, cyan, magenta, or white. Each pixel circuit includes TFTs and is configured to drive the corresponding subpixel 402 by controlling the light emitting from the respective OLED D according to control signals 108 from control logic 104. The pixel circuit may be in a 3T1C configuration (i.e., including a switching transistor Ts, a driving transistor Td, and light emitting transistor Te, and a storage capacitor C) or may include a compensation circuit (not shown) with more transistors and/or capacitors for brightness uniformity, such as in a 7T1C, 5T1C, 5T2C, or 6T1C configuration.

Gate scanning driver 304, e.g., a gate driver on array (GOA), in this embodiment sequentially applies a plurality of scan signals 604, which are generated based on control signals 602 (e.g., the first set of enable signals and first set of clock signals), to the scan lines (a.k.a. gate lines) for each row of subpixels in active region 300 in a gate scanning period of each frame at a gate scanning rate. Scan signals 604 may be applied to the gate electrode of the switching transistor Ts of each pixel circuit during the gate scanning period to turn on the switching transistor Ts so that the display data 106 for the corresponding subpixel can be written by source writing driver 306. For example, scan signals 604 may turn on the switching transistor Ts to cause the storage capacitor C to be charged at a respective level of the display data signal for the respective OLED D. As will be described below in detail, the timings of the first set of enable signals and the first set of clock signals can determine the gate scanning period of each frame and the gate scanning rate as well. To ensure writing of the correct display data 106 in each gate scanning clock period, in both FIGS. 4A and 4B, each scan line is connected to one row of subpixels. In each gate scanning clock period (e.g., determined by the clock frequency of the first set of clock signals), one row of subpixels are scanned. Thus, the gate scanning rate may be determined by the gate scanning clock frequency.

Light emitting driver 302, e.g., an emission driver on array (EOA), in this embodiment sequentially applies a plurality of emission signals 608, which are generated based on control signals 606 (e.g., the second set of enable signals and second set of clock signals), to the emission lines for each row of subpixels in active region 300 in light emitting period of each frame at light emitting rate. Light emitting driver 302 may include one or more shift registers for generating emission signals 608. Emission signals 608 provided by light emitting driver 302 may be applied to the gate electrode of the light emitting transistor Te of each pixel circuit during the light emitting period of each frame to turn on the light emitting transistor Te. In the light emitting period (i.e., when the light emitting transistor Te is turned on), the driving transistor Td may provide a driving current to the OLED D at a level determined based on the voltage level currently at the storage capacitor C. That is, by turning on the light emitting transistor Te of a subpixel, light emitting driver 302 may cause the OLED D of the subpixel to start emitting light. The OLED D may keep emitting the light until the corresponding light emitting transistor Te is turned off by light emitting driver 302. As will be described below in detail, the timings of the second set of enable signals and the second set of clock signals can determine the light emitting period of each frame, the light emitting rate, and the number of rows of subpixels that can simultaneously emit light. In FIG. 4A, each emission line is connected to one row of subpixels. In each light emitting clock period (e.g., determined by the clock frequency of the second set of clock signals), one row of subpixels may be caused to start emitting light. In FIG. 4B, each emission line is connected to two rows of subpixels. In each light emitting clock period, two rows of subpixels may be caused to start emitting light. It is to be appreciated that the number of subpixels that can start emitting light in each light emitting clock period may vary in different examples. Thus, the light emitting rate may be determined by the light emitting clock frequency and/or the number of rows of subpixels that are caused to start emitting light in each light emitting clock period.

Source writing driver 306 in this embodiment is configured to write display data 106 received from control logic 104 the subpixels in active region 300 in each frame. For example, source writing driver 306 may simultaneously apply display data signals to the data lines (a.k.a. source lines) for each column of subpixels. That is, source writing driver 306 may include one or more shift registers, digital-analog converter (DAC), multiplexers (MUX), and arithmetic circuit for controlling a timing of application of voltage to the source electrode of the switching transistor Ts of each pixel circuit and a magnitude of the applied voltage according to gradations of display data 106 in the gate scanning period of each frame. That is, the display update in each frame is synchronized with the gate scan as the corresponding display data 106 of each row of subpixels is written to the row of subpixels when the row of subpixels are scanned (i.e., each switching transistor Ts in the line is turned on by scan signals 604). Thus, source writing driver 306 may update display data 106 in each frame at a rate that is the same as the gate scanning rate.

It is to be appreciated that although one light emitting driver 302 is illustrated in FIGS. 3, 4A, and 4B, in some embodiments, multiple light emitting drivers may work in conjunction with each other. Similarly, in some embodiments, multiple gate scanning drivers and/or source writing drivers may work in conjunction with each other. It is also to be appreciated that in some embodiments, light emitting driver 302, gate scanning driver 304, and/or source writing driver 306 may not be on-panel drivers, i.e., not parts of the display panel, but instead are operatively coupled to the display panel.

Figure 7A:
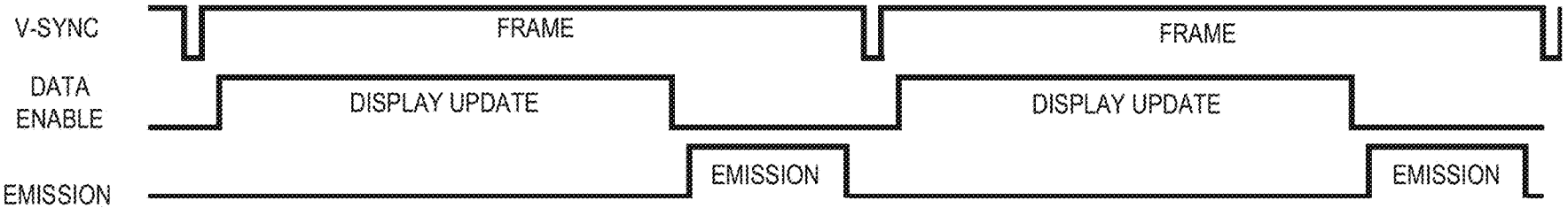
FIG. 7A is a timing diagram of low-persistence driving.

FIG. 7A is a timing diagram of low-persistence driving. The vertical synchronization (V-SYNC) signal defines consecutive frames by signifying the start of each new frame with a low voltage level. The frame rate defined by the V-SYNC signal may be the same as the standard refresh rate of the display panel (i.e., the normal frame rate). The display data enable signal (DATA ENABLE) defines a period in which the display data of each frame is updated by source writing driver 306. As described above, the display update period may be the same as the gate scanning period of each frame in which the subpixels in active region 300 are scanned by gate scanning driver 304. For example, the display update/gate scanning period may be about 80% of the frame period. For a display panel having a refresh rate of 90 Hz, the frame period is about 11.1 milliseconds (ms) and the display update/gate scanning period may be about 9 ms.

The emission control signal (EMISSION) defines the light emitting period of each frame in which the subpixels in active region 300 start emitting light. For low-persistence driving, "global emission" may be applied. For example, all the subpixels in active region 300 may simultaneously start emitting light and keep emitting light in the light emitting period because the display data of the entire frame have been updated before the start of the light emitting period. For example, the light emitting period may be about 20% of the frame period. For the display panel having the refresh rate of 90 Hz, the light emitting period may be about 2 ms. In each frame, a porch period may be defined by signals such as vertical back porch (VBP), horizontal back porch (HBP), vertical front porch (VFP), and horizontal front porch (HVP). For low-persistence driving, the porch period may be used as the light emitting period as the display data cannot be updated in the porch period.

For low-persistence driving, the display update/gate scanning period and the light emitting period are two subsequent periods in each frame. In other words, the display update/light emitting period does not overlap the light emitting period. Under low-persistence driving scheme, display update/gate scan and light emission are two mutually exclusive actions that cannot occur concurrently. None of the subpixels in active region 300 can start emitting light (so as to present the content of display image) until all the subpixels in active region 300 have been scanned (i.e., after the end of the display update/gate scanning period).

Figure 7B:
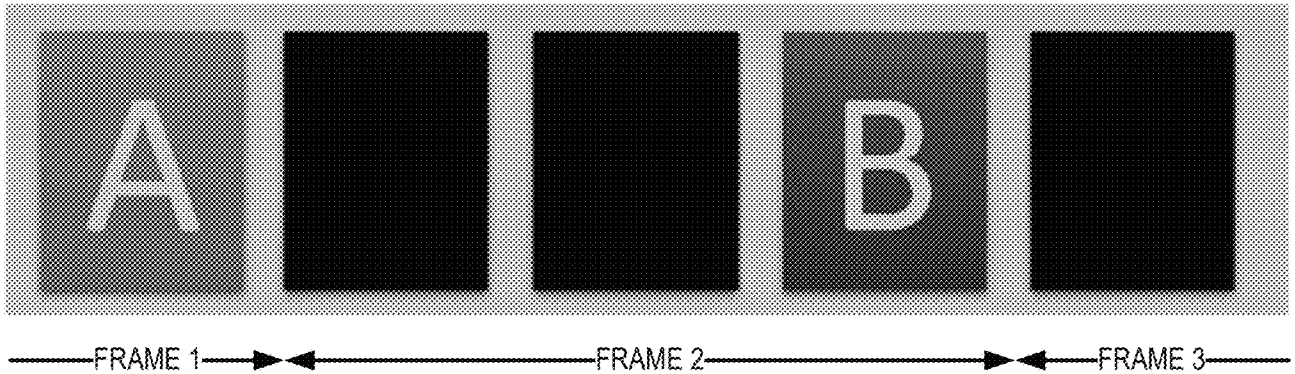
FIG. 7B is a depiction of an example of displaying images in consecutive frames by low-persistence driving.

FIG. 7B is a depiction of an example of displaying images in consecutive frames by low-persistence driving. In this example, a first display image "A" is completely presented at the end of the first frame (FRAME 1). When the second frame (FRAME 2) starts, the display update/gate scanning period starts so that the subpixels in active region 300 are scanned and updated with display data of the second display image "B." However, as the light emitting period will not start until the display update/gate scanning period ends, no content of the second display image "B" is presented during the display update/gate scanning period (represented as the first two black boxes in FRAME 2). Once all the subpixels in active region 300 have been scanned and updated with the display data of the second display image "B," the entire second display image "B" is presented in the light emitting period (represented as the third box in FRAME 2) by global emission. Again, when the third frame (FRAME 3) starts, all the subpixels in active region 300 stop emitting light as they are scanned and updated with the display data of the third display image.

As illustrated in FIGS. 7A and 7B, because the display update period (i.e., the gate scanning period) cannot overlap the light emitting period, the display update period is compressed compared with the frame period. As a result, the display data interface bandwidth increases, so does the gate scan frequency. The manufacturing complexity and cost are thus increased by low-persistence driving. Moreover, as the subpixels emit light only in the light emitting period, which is also compressed compared with the frame period, the average brightness of each frame decreases due to low-persistence driving as well.

Figure 8A:
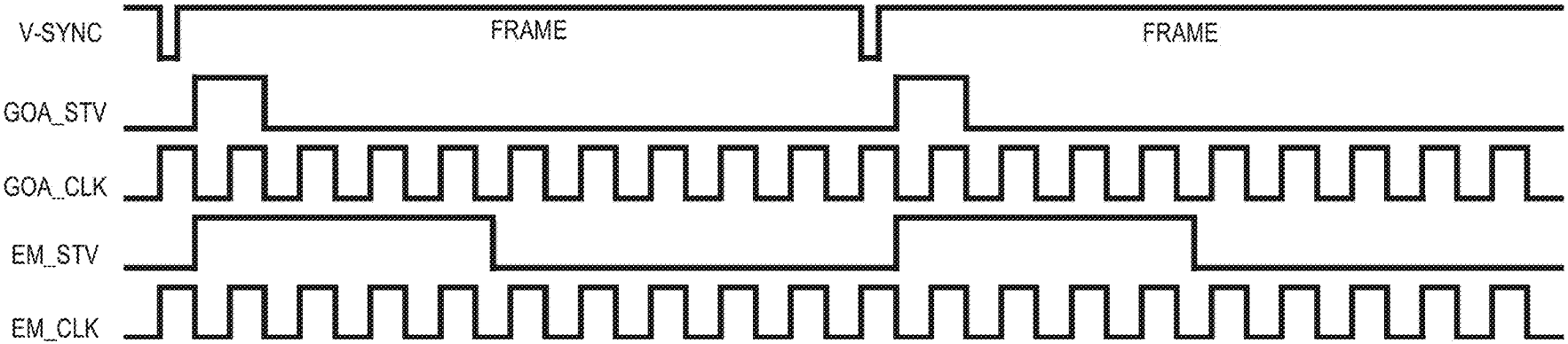
FIG. 8A is a timing diagram of line-scanning driving with emission control.

FIG. 8A is a timing diagram of line-scanning driving with emission control. The gate scanning enable signal (GOA_STV) and gate scanning clock signal (GOA_CLK) may define the gate scanning rate in each frame. The light emitting enable signal (EM_STV) and light emitting clock signal (EM_STV) may define the light emitting rate in each frame. For line-scanning driving, the gate scanning rate is usually the same as the light emitting rate. In this example, the gate scanning clock frequency is the same as the light emitting clock frequency. In each clock period, one row of subpixels (one display line) are scanned, and one row of subpixels (one display line) are caused to start emitting light. Thus, the gate scanning rate and the light emitting rate may be 1 line per clock period. The control of display update/gate scan and light emission at the same rate may be viewed as "synchronous control" because they follow the same clock frequency.

It is to be appreciated that the gate scanning rate and light emitting rate can be represented in a variety of ways. Instead of the number of display lines or rows of subpixels, the number of subpixels that are scanned or caused to start emitting light may be used to describe the gate scanning rate and light emitting rate, respectively. For example, if gate scan and light emission occur in a per row/line basis (i.e., gate scan or light emission in each clock period does not apply to a partial row of subpixels/display line), then the gate scanning rate and the light emitting rate may be aN subpixels per clock period, where a is the number of display lines/rows and N is the number of subpixels per display line/row. It is to be appreciated that in some situations, gate scan or light emission in each clock period may be applied to a partial row of subpixels/display line, i.e., less than the entire row of subpixels (e.g., one half of the entire row) are scanned or caused to start emitting light. The number of subpixels then may be used to describe the gate scanning rate and light emitting rate in these situations.

Also, instead of using clock period, a unit of time, such as millisecond (ms) or microsecond (μs) may be used as the unit of the gate scanning rate and light emitting rate. For example, for traditional line-scanning driving, as the gate scanning clock frequency is the same as the light emitting clock frequency, the clock frequency can be used to convert the gate scanning rate and light emitting rate from "lines per clock period" or "subpixels per clock period" to "lines per μs" or "subpixels per μs." It is to be appreciated that in some situations, when the gate scanning clock frequency is different from the light emitting clock frequency, either one of the clock periods (e.g., the gate scanning clock period) may be used as the unit of both rates, or time units, such as microsecond, may be used as the unit of both rates.

Different from low-persistence driving, the display update/gate scanning period can overlap the light emitting period for line-scanning driving. In other words, at least one subpixel is scanned while at least one subpixel is caused to start emitting light. Thus, the lengths of display update/gate scanning period and light emitting period do not restrict each other. For example, the light emitting period may be substantially the same as the frame period, i.e., there is always at least one subpixel emitting light during the entire frame period. The display update/gate scanning period may be substantially the same as the frame period (minus the porch period if there is one).

Emission control can be combined with line-scanning driving, as shown in FIG. 8A, to control the number of subpixels that can simultaneously emit light. Different from the global emission in low-persistence driving, only a portion of subpixels that can simultaneously emit light. This may be done by the timing of EM_STV as shown in FIG. 8A. In this example, one half of the subpixels can simultaneously emit light.

Figure 8B:
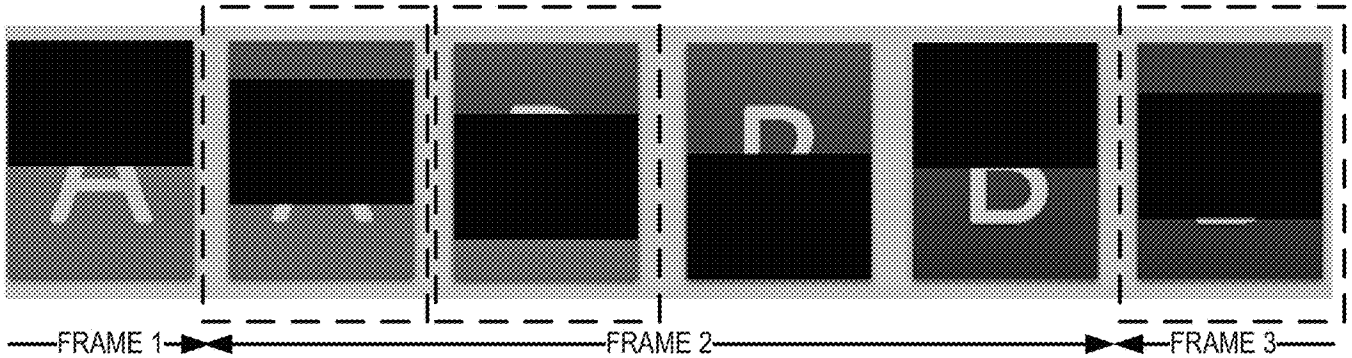
FIG. 8B is a depiction of an example of displaying images in consecutive frames by line-scanning driving with emission control.

FIG. 8B is a depiction of an example of displaying images in consecutive frames by line-scanning driving with emission control. Different from the low-persistence driving example shown in FIG. 7B, there is always content of a display image presented at any time of each frame because the light emitting period can be substantially the same as the frame period. Also, because of the emission control, one half of the display panel always cannot present any display content because only one half of the subpixels can emit light at the same time as defined by EM_STV in FIG. 8A. Moreover, content of display images of two different frames may be simultaneously presented because the gate scanning period overlaps the light emitting period and the gate scanning rate is the same as the light emitting rate. For example, in the three boxes highlighted with dash lines, because the gate scan and light emission do not finish at the same time at the end of each frame, "image broken" can appear, which as described above, can cause cybersickness and motion blur.

Figure 9A:
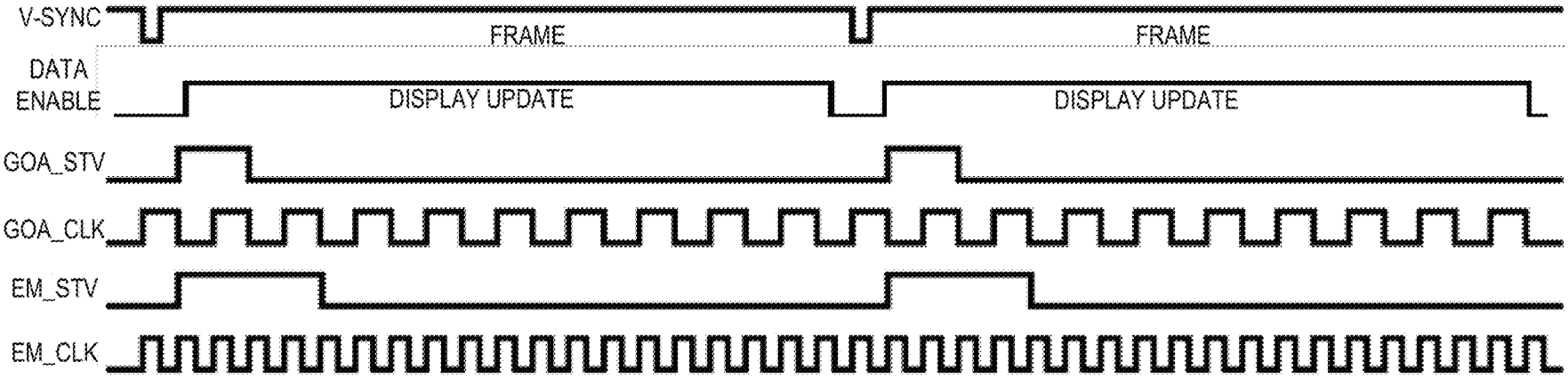
FIG. 9A is a timing diagram of an example of asynchronous control of display update and light emission in accordance with an embodiment.

FIG. 9A is a timing diagram of an example of asynchronous control of display update and light emission in accordance with an embodiment. Different from low-persistence driving, for example as shown in FIG. 7A, the display update/gate scanning period (e.g., defined by DATA ENABLE) in this embodiment overlaps the light emitting period to avoid the problems caused by low-persistence driving, such as the increase of display data interface bandwidth and gate scan frequency and decrease of average brightness of each frame. On the other hand, different from line-scanning driving with emission control, for example as shown in FIG. 8A, the light emitting rate is higher than the display update/gate scanning rate because the light emitting clock frequency is higher than the gate scanning clock frequency (assuming the number of rows of subpixels that can be scanned in each gate scanning clock period is the same as the number of rows of subpixels that can be caused to start emitting light in each light emitting clock period). By asynchronous control of display update and light emission, it is possible that in each frame, the light emission starts later than data update/gate scan and finishes earlier than data update/gate scan of next frame, thereby preventing "image broken" and cybersickness and motion blur caused thereby.

In this embodiment, gate scanning driver 304 scans the subpixels in active region 300 in a gate scanning period of each frame at a gate scanning rate in accordance with the first set of control signals 602 generated by control logic 104. The gate scanning rate is determined based on the first set of clock signals (e.g., GOA_CLK) in the first set of control signals 602. The first set of control signals 602 may further include display data enable signal (DATA ENABLE) that defines the gate scanning period (i.e., display update period). It is to be appreciated that in some embodiments, the gate scanning rate can also be determined based on the number of subpixels (e.g., the display lines) that can be scanned in each gate scanning clock period. For ease of description, this number is assumed to be always the same, i.e., one display line, in the present disclosure.

In this embodiment, light emitting driver 302 causes the subpixels in active region 300 to start emitting light in light emitting period of each frame at light emitting rate in accordance with the second set of control signals 606 generated by control logic 104. The light emitting rate is determined based on the second set of clock signals (e.g., EM_CLK) in the second set of control signals 606. The second set of control signals 606 further includes the second set of enable signals (e.g., EM_STV) that determine the number of rows of subpixels that can simultaneously emit light in each frame caused by light emitting driver 302.

The light emitting rate is also determined based on the number of subpixels (e.g., the display lines) that can be caused to start emitting light in each light emitting clock period. In this embodiment, assuming this number is the same as the number of subpixels that can be scanned in each gate scanning clock period, because the light emitting clock frequency is higher than the gate scanning clock frequency, the light emitting rate is higher than the gate scanning rate. It is to be appreciated that the unit of the gate scanning rate and light emitting rate in this embodiment can be "lines per clock period," "subpixels per clock period," "lines per μs," or "subpixels per μs." Because the gate scanning rate and the light emitting rate in this embodiment are different, for ease of comparison, "lines per μs" or "subpixels per μs" may be used as the unit of the gate scanning rate and the light emitting rate. That is, the gate scanning rate represents the number of display lines or subpixels that are scanned by gate scanning driver 304 in each unit of time (e.g., μs) in the gate scanning period, and the light emitting rate represents the number of display lines or subpixels that are caused to start emitting light by light emitting driver 302 in each unit of time (e.g., μs) in the light emitting period. It is to be appreciated that the gate scanning rate and the light emitting rate can be measured and represented in a per clock period basis, for example using the unit of "lines per clock period" or "subpixels per clock period." Because the gate scanning clock period and the light emitting clock period are different in this embodiment, the clock period used for measuring both rates may be one of the clock periods, such as the gate scanning clock period.

In the example of FIG. 9A, the light emitting clock frequency is about twice of the gate scanning clock frequency. Thus, the light emitting rate is about twice of the gate scanning rate, i.e., 100% higher than the gate scanning rate. For example, in each gate scanning clock period, one row of subpixels are scanned with updated display data, while two rows of subpixels are caused to start emitting light. In some embodiments, the light emitting rate may be at least 10% higher than the gate scanning rate, such as 20%, 30%, 40%, 50%, 60%, 70%, 80%, 90%, or 100% higher than the gate scanning rate. In some embodiments, the light emitting rate may be at least 100% higher than the gate scanning rate, such as 200%, 300%, 400%, or 500% higher than the gate scanning rate. The average brightness of each frame (i.e., the emission duty) may be determined based at least in part on the ratio of the light emitting rate and the gate scanning rate. By adjusting the ratio of the light emitting rate and the gate scanning rate, the display panel driving scheme disclosed herein can flexibility adjust the average brightness of each frame as desired.

In this embodiment, the gate scanning period (i.e., the display update period) overlaps the light emitting period in each frame. For example, the light emitting period may overlap the gate scanning period at least 10% of the frame period, such as 20%, 30%, 40%, 50%, 60%, 70%, 80%, 90%, 95%, 97%, etc. It is to be appreciated in some embodiments, because the gate scanning period cannot overlap the porch period, the maximum gate scanning period may be the frame period minus the porch period. As to the light emitting period, it may be as long as the frame period. Thus, in some embodiments, the light emitting period may overlap the gate scanning period in the frame period minus the porch period. Another way to understand the overlapping of the gate scanning period and light emitting period is that, in the overlapped period, gate scanning driver 304 scans a first set of the subpixels in active region 300 while light emitting driver 302 causes a second set of subpixels in active region 300 to start emitting light. That is, in this embodiment, display update/gate scan and light emission are not mutually exclusive actions and can occur concurrently on the display panel, even though maybe with respect to different subpixels. The number of the first or second set of subpixels may be at least 10% of the number of the subpixels in active region 300, such as 20%, 30%, 40%, 50%, 60%, 70%, 80%, 90%, 95%, 97%, etc. As described above, a display panel may include a porch region in which light emitting elements can emit light but cannot be scanned to present any content of a display image. Thus, in some embodiments, the maximum number of the first set of subpixels may be the number of subpixels in the display region of a display panel, while the maximum number of the second set of subpixels may include the light emitting elements in the porch region of the display panel as well.

Figure 9B:
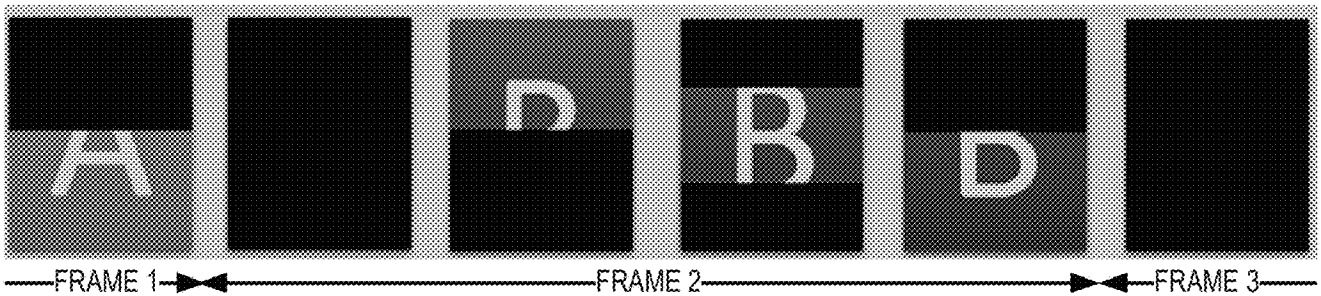
FIG. 9B is a depiction of an example of displaying images in consecutive frames by asynchronous control of display update and light emission in accordance with an embodiment.

FIG. 9B is a depiction of an example of displaying images in consecutive frames by asynchronous control of display update and light emission in accordance with an embodiment. As shown in FIG. 9B, different from line-scanning driving, for example as shown in FIG. 8B, "image broken" is avoided in each frame due to the asynchronous control of display update and light emission. At the beginning of each frame (e.g., the first black boxes in FRAME 2 and FRAME 3), gate scanning driver 304 first starts to scan the subpixels while light emitting driver 302 has not caused any subpixels to start emitting light yet. This ensures that if there is any subpixels that have not been scanned and updated with the display data from the current frame (i.e., still having display data from the previous frame), those subpixels will not emit light so as to avoid displaying content from different frames at the same time in the beginning of each frame.

Because gate scanning driver 304 starts to scan the subpixels earlier than when light emitting driver 302 starts to cause the subpixels to emit light, if the gate scanning rate is the same as or higher than the light emitting rate, then at the end of each frame, display update/gate scan and light emission cannot finish at least at the same time, which may cause "image broken" as well. In this embodiment, by setting the light emitting rate higher than the gate scanning rate, display update/gate scan and light emission can finish at least at the same time in each frame.

As described above, the light emitting rate can be adjusted by controlling the light emitting clock frequency and/or the number of subpixels (e.g., display lines) that can be caused to start emitting light in each light emitting clock period. In the example of FIG. 9A, the light emitting rate is higher than the gate scanning rate by making the light emitting clock frequency higher than the gate scanning clock frequency. In some embodiments, the light emitting clock frequency may remain the same as the gate scanning clock frequency, and the light emitting rate may be higher than the gate scanning rate by making the number of subpixels that can be caused to start emitting light higher than the number of subpixels that can be scanned in each clock period. For example, in the example of FIG. 4B, assuming the light emitting clock frequency is the same as the gate scanning clock frequency, then the light emitting rate may be twice of the gate scanning rate because in each clock period, two rows of subpixels are caused by light emitting driver 302 to start emitting light while one row of subpixels are scanned by gate scanning driver 304.

Figure 10:
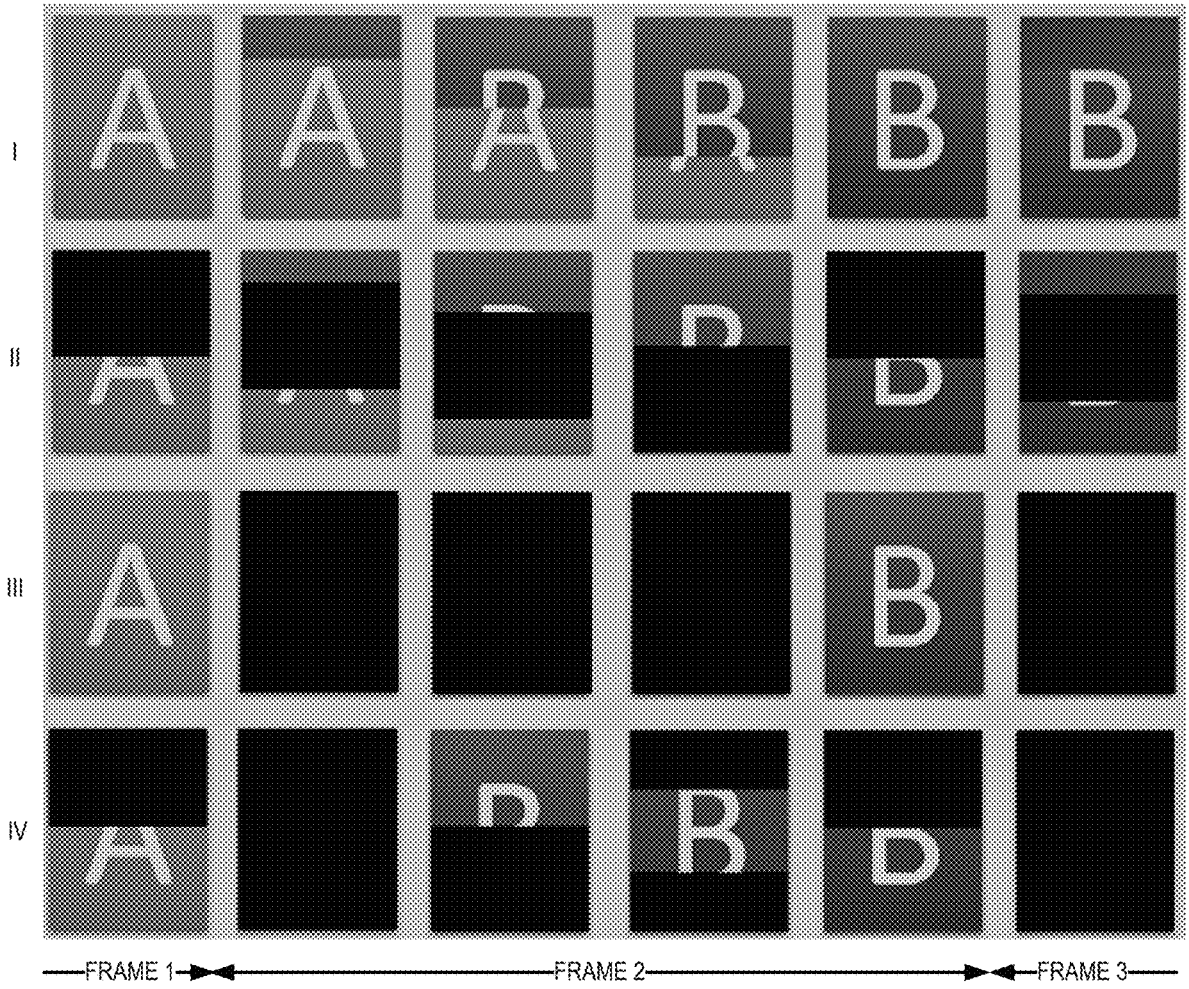
FIG. 10 is a depiction of displaying images in consecutive frames by various display panel driving schemes including asynchronous control of display update and light emission in accordance with an embodiment.

FIG. 10 is a depiction of displaying images in consecutive frames by various display panel driving schemes including asynchronous control of display update and light emission in accordance with an embodiment. FIG. 10 compares the display panel driving scheme disclosed herein (IV) with other display panel driving schemes, such as line-scanning driving without emission control (I), line-scanning driving with emission control (II), and low-persistence driving (III). As noted above, line-scanning driving schemes I and II suffer from "image broken" at least because of their synchronous control of display update and light emission. As to low-persistence driving scheme III, the mutually exclusive deign of display update and light emission introduces undesirable increase of system load and cost and the insufficient brightness in some applications. The display panel driving scheme disclosed herein (IV), however, can overcome the above-mentioned problems by asynchronous control of display update and light emission with overlap.

Figure 11:
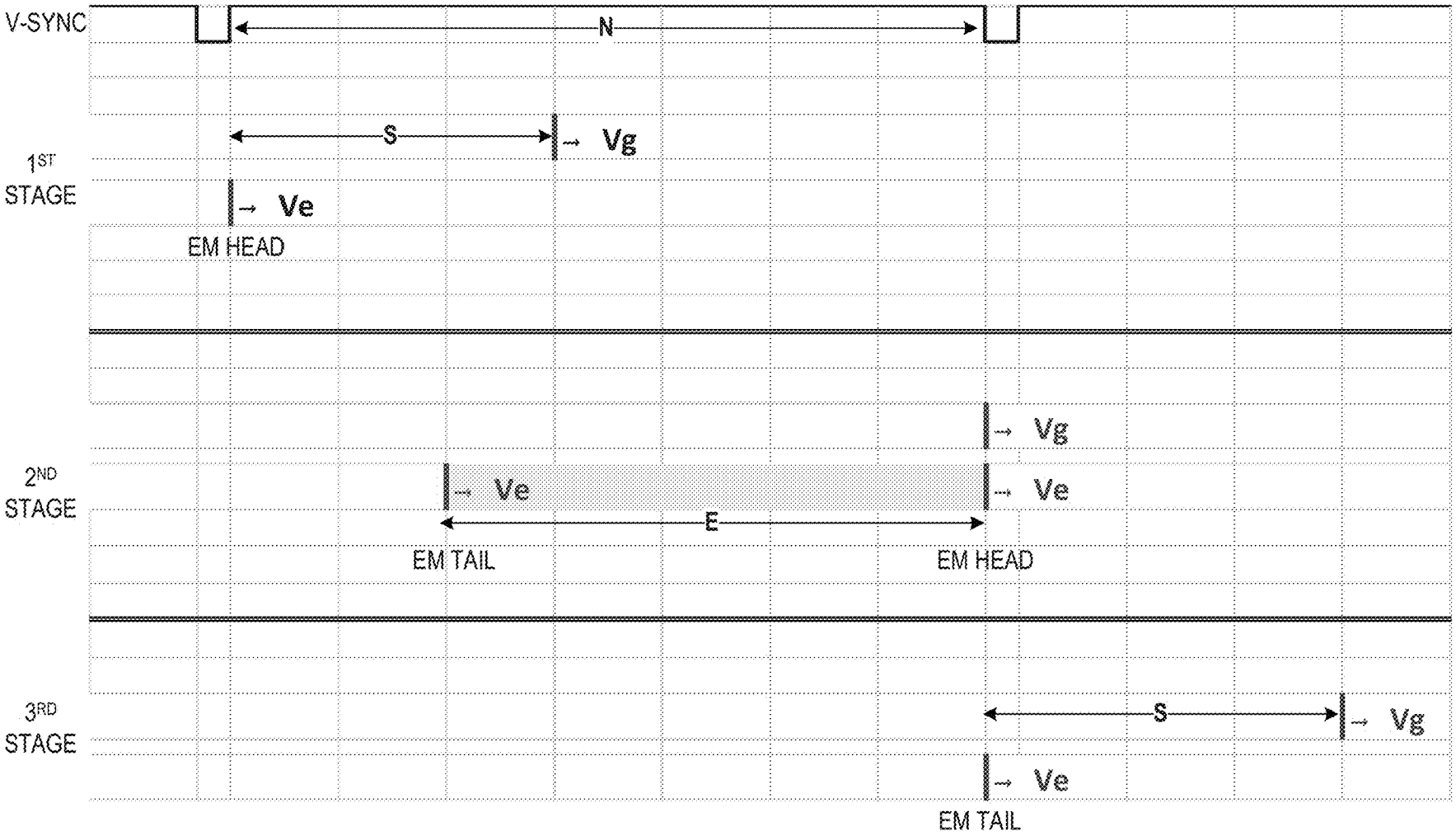
FIG. 11 is a depiction of boundary conditions of asynchronous control of display update and light emission in accordance with an embodiment.

FIG. 11 is a depiction of boundary conditions of asynchronous control of display update and light emission in accordance with an embodiment. The boundary conditions described in this embodiment may be used to set the values of some parameters, such as the gate scanning rate Vg and light emitting rate Ve, so that "image broken" can be avoided. In this embodiment, N is the number of the plurality of subpixels in active region 300. As described above, in some embodiments, gate scanning driver 304 may scan a portion of subpixels in a row (display line), as opposed to the entire row, in each gate scanning clock period. Similarly, light emitting driver 302 may cause a portion of subpixels in a row to start emitting light in each light emitting clock period. Thus, instead of using the number of rows of subpixels (display lines), the number of subpixels is used in this embodiment as a more generic parameter for calculating the boundary conditions. It is to be appreciated that in the examples in which the display update/gate scan and light emission always apply to the entire display lines, N may be the number of display lines. Also, as described above, active region 300 may be the entire display panel, the display region (without the porch region), one or more zones divided from the display panel, or any portion of the display panel. Thus, N can be, but is not limited to, the total number of subpixels on the display panel.

In this embodiment, S is the number of subpixels that have been scanned by gate scanning driver 304 in each frame when light emitting driver 302 causes the first subpixel of the plurality of subpixels to start emitting light. As shown in FIG. 9B, when light emitting driver 302 starts to cause the subpixels to start emitting light, gate scanning driver 304 may have already scanned a number of subpixels. S thus also relates to the duration of the first black boxes in FRAME 2 and FRAME 3 of FIG. 9B. In this embodiment, E is the number of subpixels that simultaneously emit light caused by light emitting driver 302 in each frame. For example, E may be determined by the timing of EM_STV as shown in FIG. 9A and relate to the size of the region in which display content can be presented as shown in FIG. 9B.

In the first stage in FIG. 11, EM HEAD represents that light emitting driver 302 starts to cause the subpixels to start emitting light from the first subpixel at a rate of Ve, while at the same moment, gate scanning driver 304 has scanned S subpixels at a rate of Vg. In order to avoid "image broken," at the end of this frame, the boundary condition is that when gate scanning driver 304 scans the last subpixel, light emitting driver 302 also causes the last subpixel to start emitting light. N, S, Vg, and Ve thus need to satisfy that $N/Ve \geq (N-S)/Vg$ and $Vg<Ve$. In other words, $S \leq N(1-Vg/Ve)$.

In the second stage in FIG. 11, EM TAIL represents the end of E, i.e., the last subpixel that still remains emitting light, when both gate scanning driver 304 and light emitting driver 302 reach to the last subpixel at the end of the frame. In the third stage in FIG. 11, the boundary condition is that in the next frame when gate scanning driver 304 has scanned S subpixels, light emitting driver 302 causes all the E subpixels to stop emitting light, thereby avoiding present display content of the previous frame. Thus, E, S, Vg, and Ve need to satisfy that $S/Vg \geq E/Ve$ and $Vg<Ve$. In other words, $E \leq S(Ve/Vg)$.

Accordingly, in this embodiment, to avoid "image broken," i.e., displaying content from two consecutive frames, the parameters N, S, E, Vg, and Ve need to satisfy:

$$Vg<Ve \tag{1}$$

$$S \leq N(1-Vg/Ve) \tag{2}$$

$$E \leq S(Ve/Vg) \tag{3}$$

Figure 12A:
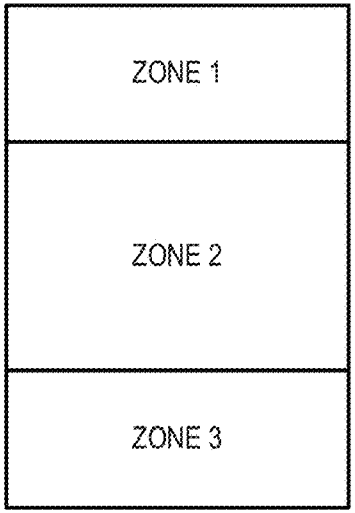
FIG. 12A is a depiction of an example of a display panel divided into multiple zones.
Figure 12B:
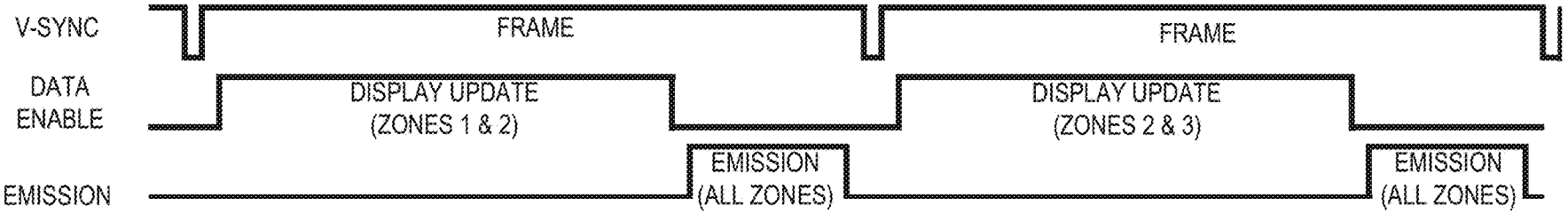
FIG. 12B is a timing diagram of low-persistence driving applied to the display panel shown in FIG. 12A.

FIG. 12A is a depiction of an example of a display panel divided into multiple zones. A display panel may be divided into a plurality of zones, such as ZONE 1, ZONE 2, and ZONE 3 as shown in FIG. 12A. By applying a zone-based display data processing and transmission scheme to the display panel shown in FIG. 12A, the average data bandwidth at the display interface may be reduced. For example, FIG. 12B is a timing diagram of low-persistence driving applied to the display panel shown in FIG. 12A. In this example, display data for subpixels in ZONE 2 is updated in each frame, while display data for subpixels in ZONE 1 and ZONE 3 is updated in every other frame. Details of the zone-based display data processing and transmission scheme are disclosed in PCT Patent Application No. PCT/CN2016/108175, having a title of "Zone-Based Display Data Processing and Transmission," which is incorporated herein by reference.

Figure 13:
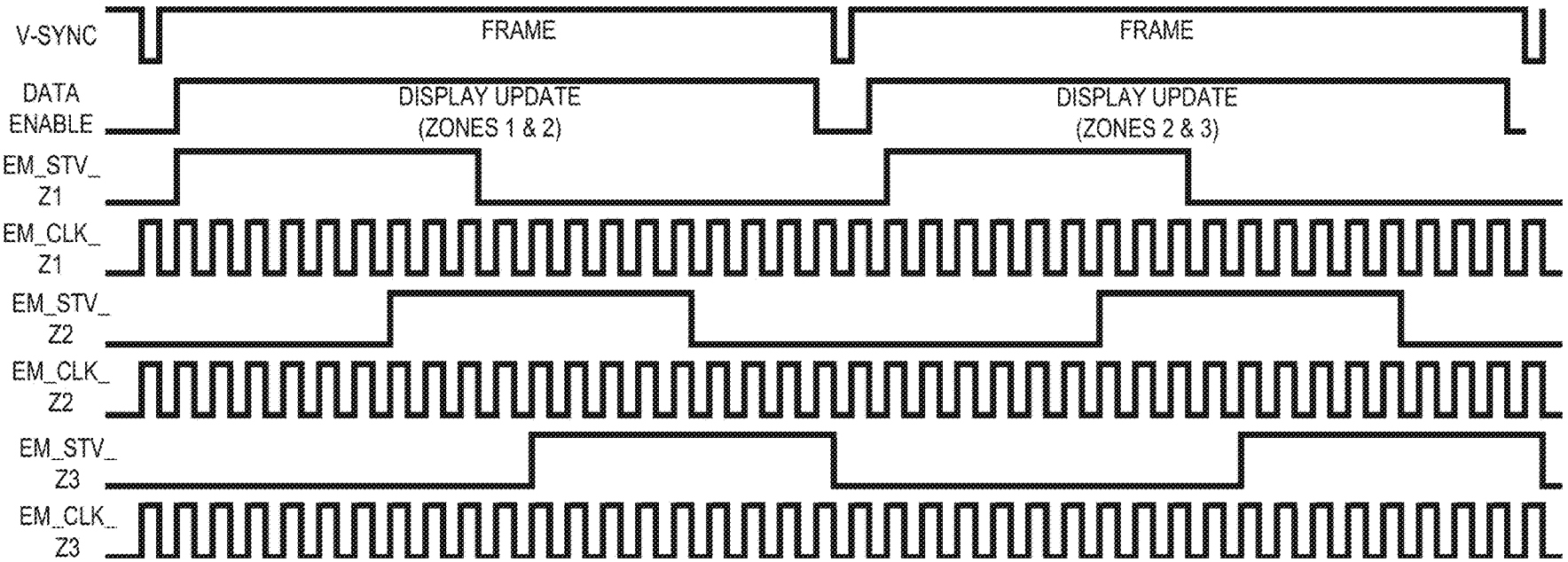
FIG. 13 is a timing diagram of an example of asynchronous control of display update and light emission applied to the display panel shown in FIG. 12A in accordance with an embodiment.

FIG. 13 is a timing diagram of an example of asynchronous control of display update and light emission applied to the display panel shown in FIG. 12A in accordance with an embodiment. As shown in FIG. 13, the display update timing is the same as the one shown in FIG. 12B. As to the light emitting control, each zone may be considered as active region 300, and the same asynchronous control of display update and light emission scheme described above may be applied to each zone as well. It is to be appreciated that in some embodiments, as ZONE 1 and ZONE 3 do not update display data in each frame, the asynchronous control of display update and light emission scheme may not be applied to ZONE 1 and ZONE 3, but applied only to ZONE 2.

Figure 14:
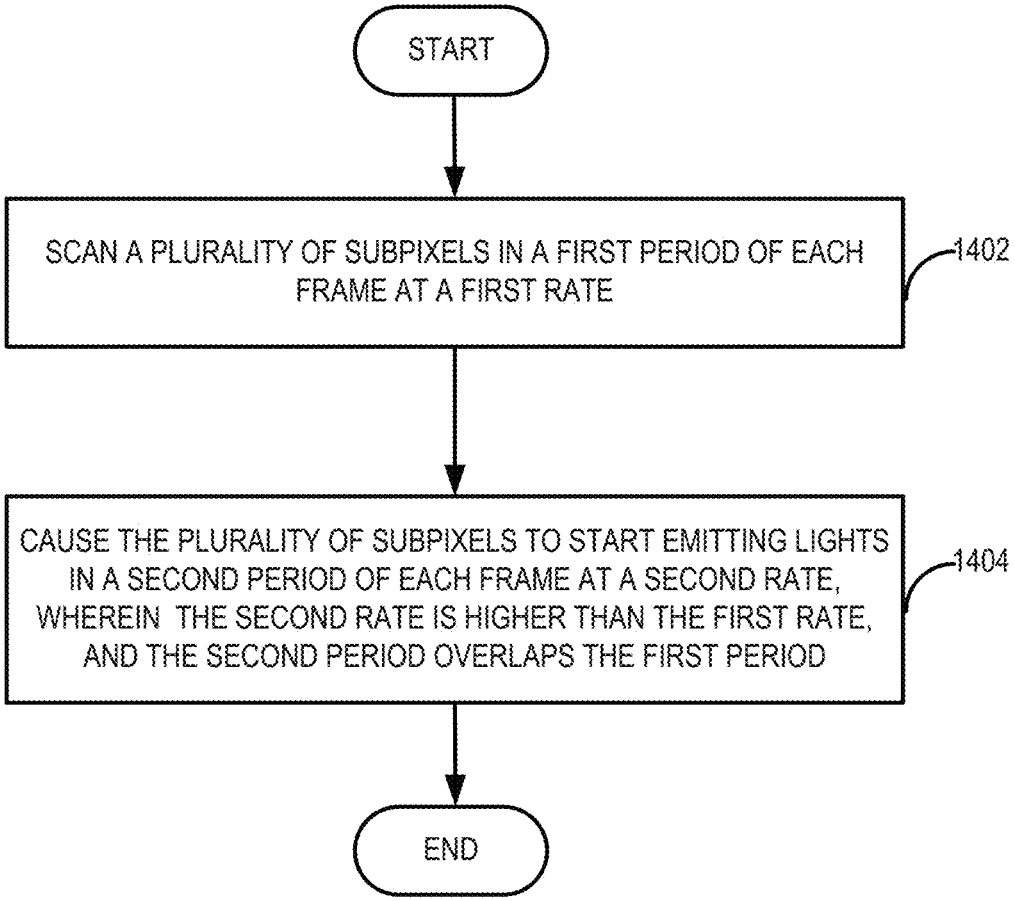
FIG. 14 is a flow chart of a method for driving a plurality of subpixels on a display panel in accordance with an embodiment.

FIG. 14 is a flow chart of a method for driving a plurality of subpixels on a display panel in accordance with an embodiment. It will be described with reference to the above figures. However, any suitable circuit, logic, unit, or module may be employed. The method can be performed by any suitable circuit, logic, unit, or module that can comprise hardware (e.g., circuitry, dedicated logic, programmable logic, microcode, etc.), software (e.g., instructions executing on a processing device), firmware, or a combination thereof.

Starting at 1402, the plurality of subpixels are scanned in a first period (e.g., the gate scanning period) in each frame at a first rate (e.g., the gate scanning rate). This may be performed by gate scanning driver 304. At 1404, the plurality of subpixels are caused to start emitting light in a second period (e.g., the light emitting period) in each frame at a second rate (e.g., the light emitting rate). This may be performed by light emitting driver 302. In this embodiment, the second rate is higher than the first rate. Moreover, in this embodiment, the second period overlaps the first period. In some embodiments, the second period overlaps the first period at least 10% of a period of the frame. In some embodiments, during a period when the second period overlaps the first period, a first set of the plurality of subpixels are scanned while a second set of the plurality of subpixels are caused to start emitting light. For example, the number of the first or second set of the plurality of subpixels is at least 10% of the number of the plurality of subpixels. As noted above, in some embodiments, 1402 and 1404 may overlap with each other or occur at substantially the same time.

Also, integrated circuit design systems (e.g. work stations) are known that create wafers with integrated circuits based on executable instructions stored on a computer-readable medium such as but not limited to CDROM, RAM, other forms of ROM, hard drives, distributed memory, etc. The instructions may be represented by any suitable language such as but not limited to hardware descriptor language (HDL), Verilog or other suitable language. As such, the logic, units, and circuits described herein may also be produced as integrated circuits by such systems using the computer-readable medium with instructions stored therein.

For example, an integrated circuit with the aforedescribed logic, units, and circuits may be created using such integrated circuit fabrication systems. The computer-readable medium stores instructions executable by one or more integrated circuit design systems that causes the one or more integrated circuit design systems to design an integrated circuit. In one example, the designed integrated circuit includes a timing controller and a clock generator. The timing controller is configured to provide a first set of enable signals and a second set of enable signals. The clock generator is configured to provide a first set of clock signals associated with a first clock frequency and a second set of clock signals associated with a second clock frequency that is higher than the first clock frequency. The first set of enable signals and the first set of clock signals control a gate scanning driver to sequentially scan a plurality of rows of subpixels on a display panel in accordance with the first clock frequency. The second set of enable signals and the second set of clock signals control light emitting driver to sequentially cause the plurality of rows of subpixels to start emitting light in accordance with the second clock frequency.

The above detailed description of the disclosure and the examples described therein have been presented for the purposes of illustration and description only and not by limitation. It is therefore contemplated that the present disclosure cover any and all modifications, variations or equivalents that fall within the spirit and scope of the basic underlying principles disclosed above and claimed herein.

What is claimed is:

1. An apparatus for display, comprising:

an active region comprising a plurality of subpixels arranged in an array having a plurality of rows of subpixels;

a gate scanning driver operatively coupled to the active region and configured to scan the plurality of subpixels in a first period of each frame at a first rate, the gate scanning driver sequentially scanning the plurality of rows of subpixels in accordance with a first clock frequency; and light emitting driver operatively coupled to the active region and configured to cause the plurality of subpixels to start emitting light in a second period of each frame at a second rate, the light emitting driver sequentially causing the plurality of rows of subpixels to start emitting light in accordance with a second clock frequency, wherein the second rate is higher than the first rate, the second period overlaps the first period, the second clock frequency is higher than the first clock frequency, and a first number of rows of subpixels scanned by the gate scanning driver in each first clock period is the same as a second number of rows of subpixels that start to emitting light in each second clock period caused by the light emitting driver.

2. The apparatus of claim 1, wherein $N/Ve \geq (N-S)/Vg$, where N is the number of the plurality of subpixels, S is the number of subpixels that have been scanned by the gate scanning driver in each frame when the light emitting driver causes the first subpixel of the plurality of subpixels to start emitting light, Vg is the first rate, and Ve is the second rate.

3. The apparatus of claim 1, wherein $S/Vg \geq E/Ve$, where E is the number of subpixels that simultaneously emit light caused by the light emitting driver in each frame, S is the number of subpixels that have been scanned by the gate scanning driver in each frame when the light emitting driver causes the first subpixel of the plurality of subpixels to start emitting light, Vg is the first rate, and Ve is the second rate.

4. The apparatus of claim 1, wherein the second period overlaps the first period at least 10% of a period of the frame.

5. The apparatus of claim 1, wherein during a period when the second period overlaps the first period, the gate scanning driver scans a first set of the plurality of subpixels while the light emitting driver causes a second set of the plurality of subpixels to start emitting light.

6. The apparatus of claim 5, wherein a number of the first or second set of the plurality of subpixels is at least 10% of a number of the plurality of subpixels.

7. The apparatus of claim 1, wherein the second rate is at least 10% higher than the first rate.

8. The apparatus of claim 7, wherein the second rate is about 100% higher than the first rate.

9. The apparatus of claim 1, wherein the active region is one of a plurality of zones divided from a display panel.

10. The apparatus of claim 1, further comprising:

control logic operatively coupled to the gate scanning driver and the light emitting driver and configured to provide a plurality of control signals to the gate scanning driver and the light emitting driver to control operations of the gate scanning driver and the light emitting driver, wherein the control signals comprises:

a first set of enable signals and a first set of clock signals provided to the gate scanning driver, and a second set of enable signals and a second set of clock signals provided to the light emitting driver.

11. The apparatus of claim 10, wherein the gate scanning driver scans the plurality of subpixels in accordance with a first clock frequency associated with the first set of clock signals;

the light emitting driver causes the plurality of subpixels to start emitting light in accordance with a second clock frequency associated with the second set of clock signals; and the second frequency is higher than a first frequency.

12. The apparatus of claim 1, wherein each of the plurality of subpixels comprises light emitting element.

13. A system for display, comprising:

an active region comprising a plurality of subpixels arranged in an array having a plurality of rows of subpixels;

control logic configured to provide a plurality of control signals comprising a first set of enable signals, a first set of clock signals, a second set of enable signals, and a second set of clock signals;

a gate scanning driver operatively coupled to the active region and the control logic and configured to scan the plurality of subpixels in a first period of each frame at a first rate based at least in part on the first set of enable signals and the first set of clock signals, the gate scanning driver sequentially scanning the plurality of rows of subpixels in accordance with a first clock frequency associated with the first set of clock signals; and light emitting driver operatively coupled to the active region and the control logic and configured to cause the plurality of subpixels to start emitting light in a second period of each frame at a second rate based at least in part on the second set of enable signals and the second set of clock signals, the light emitting driver sequentially causing the plurality of rows of subpixels to start emitting light in accordance with a second clock frequency associated with the second set of clock signals, wherein the second rate is higher than the first rate, the second period overlaps the first period, the second clock frequency is the same as the first clock frequency, and a first number of rows of subpixels scanned by the gate scanning driver in each first clock period is less than a second number of rows of subpixels that start to emitting light in each second clock period caused by the light emitting driver.

14. An apparatus, comprising:

a timing controller configured to provide a first set of enable signals and a second set of enable signals; and a clock generator configured to provide a first set of clock signals associated with a first clock frequency and a second set of clock signals associated with a second clock frequency that is higher than the first clock frequency, wherein the first set of enable signals and the first set of clock signals control a gate scanning driver to sequentially scan a plurality of rows of subpixels on a display panel in accordance with the first clock frequency, the second set of enable signals and the second set of clock signals control a light emitting driver to sequentially cause the plurality of rows of subpixels to start emitting light in accordance with the second clock frequency, and a first number of rows of subpixels scanned by the gate scanning driver in each first clock period is the same as a second number of rows of subpixels that start to emitting light in each second clock period caused by the light emitting driver.

15. A method for driving a plurality of subpixels arranged in an array having a plurality of rows of subpixels on a display panel, comprising:

scanning, using a gate scanning driver, the plurality of subpixels in a first period of each frame at a first rate, the gate scanning driver sequentially scanning the plurality of rows of subpixels in accordance with a first clock frequency; and causing, using a light emitting driver, the plurality of subpixels to start emitting light in a second period of each frame at a second rate, the light emitting driver sequentially causing the plurality of rows of subpixels to start emitting light in accordance with a second clock frequency, wherein the second rate is higher than the first rate, the second period overlaps the first period, the second clock frequency is the same as the first clock frequency, and a first number of rows of subpixels scanned by the gate scanning driver in each first clock period is less than a second number of rows of subpixels that start to emitting light in each second clock period caused by the light emitting driver.

16. The method of claim 15, wherein the second period overlaps the first period at least 10% of a period of the frame.

17. The method of claim 15, wherein during a period when the second period overlaps the first period, a first set of the plurality of subpixels are scanned while a second set of the plurality of subpixels are caused to start emitting light.

18. The method of claim 17, wherein a number of the first or second set of the plurality of subpixels is at least 10% of a number of the plurality of subpixels.

* * * * *